US010656581B2

(12) United States Patent
Fuse et al.

(10) Patent No.: US 10,656,581 B2
(45) Date of Patent: May 19, 2020

(54) IMAGE FORMING APPARATUS

(71) Applicant: CANON KABUSHIKI KAISHA, Tokyo (JP)

(72) Inventors: Takahito Fuse, Nagareyama (JP); Masami Hano, Abiko (JP); Kenichiro Kitajima, Toride (JP); Tadashi Fukuda, Tokyo (JP); Shota Soda, Abiko (JP); Hidetaka Nakahara, Kawasaki (JP); Hiroyuki Amano, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/936,084

(22) Filed: Mar. 26, 2018

(65) Prior Publication Data

US 2018/0284671 A1 Oct. 4, 2018

(30) Foreign Application Priority Data

Mar. 31, 2017 (JP) ..... 2017-072715

(51) Int. Cl.

| | |
|---|---|
| ***G03G 15/00*** | (2006.01) |
| *G03G 15/04* | (2006.01) |
| *B41J 29/38* | (2006.01) |
| *G03G 21/14* | (2006.01) |

(52) U.S. Cl.

CPC ..... *G03G 15/5004* (2013.01); *B41J 29/38* (2013.01); *G03G 15/0409* (2013.01); *G03G 15/04072* (2013.01); *G03G 15/5016* (2013.01); *G03G 21/14* (2013.01); *G03G 2215/0404* (2013.01)

(58) Field of Classification Search

CPC ..... G03G 15/5004; G03G 15/04072; G03G 15/0409; G03G 21/14; G03G 2215/0404; G03G 15/5016; B41J 29/38

See application file for complete search history.

(56) References Cited

U.S. PATENT DOCUMENTS

| | | | | |
|---|---|---|---|---|
| 5,828,925 A * | 10/1998 | Yoshizawa | ..... | H04N 1/00002 399/39 |
| 6,414,777 B1 * | 7/2002 | Miyamoto | ..... | G02B 26/121 310/261.1 |
| 2002/0025180 A1 * | 2/2002 | Kimizuka | ..... | G03G 21/206 399/92 |

(Continued)

FOREIGN PATENT DOCUMENTS

| | | |
|---|---|---|
| JP | 2012-114500 A | 6/2012 |
| JP | 2012-118253 A | 6/2012 |

(Continued)

*Primary Examiner* — Yaovi M Ameh

(74) *Attorney, Agent, or Firm* — Canon U.S.A., Inc. IP Division

(57) ABSTRACT

An image forming apparatus has a changing portion configured to change, based on a detection result of a temperature sensor, response sensitivity in starting of power supply by a determination portion based on a detection result of a human body detection sensor in a case where a human body approaches the human body detection sensor. The changing portion increases the sensitivity in a case where a temperature detected by the temperature sensor is a second temperature lower than a first temperature than in a case where the temperature detected by the temperature sensor is the first temperature.

10 Claims, 26 Drawing Sheets

(56) References Cited

U.S. PATENT DOCUMENTS

| | | | | |
|---|---|---|---|---|
| 2009/0080928 | A1* | 3/2009 | Takano | G03G 15/2039 399/69 |

FOREIGN PATENT DOCUMENTS

| | | | | | |
|---|---|---|---|---|---|
| JP | 2016-122060 | A | * | 7/2016 | G03G 21/14 |
| JP | 2017-019199 | | * | 1/2017 | G03G 21/00 |
| JP | 2017-19199 | A | | 1/2017 | |

* cited by examiner

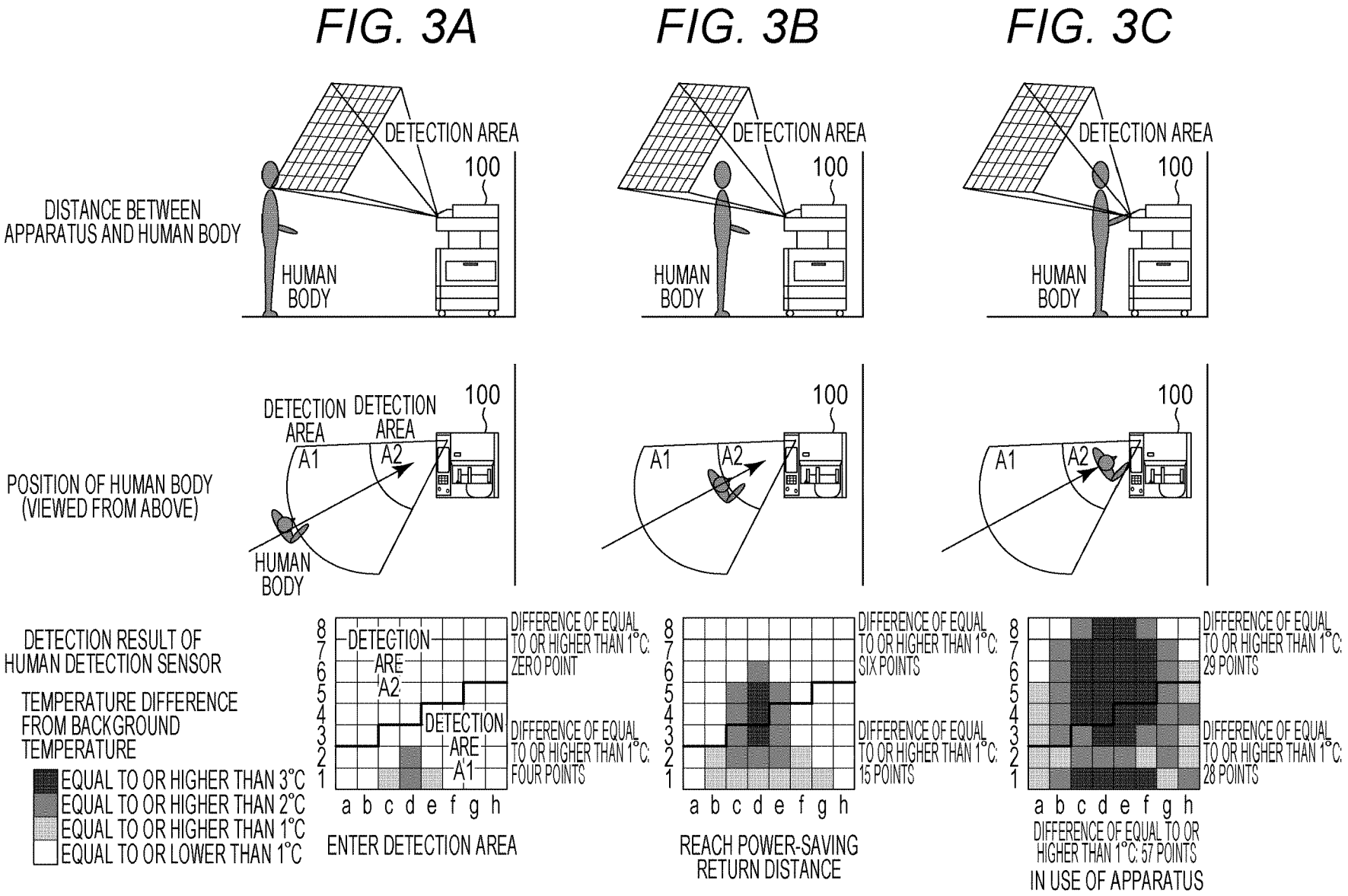
FIG. 3A
FIG. 3B
FIG. 3C
DETECTION AREA
100
HUMAN BODY
DISTANCE BETWEEN APPARATUS AND HUMAN BODY
DETECTION AREA
A1
A2
HUMAN BODY
POSITION OF HUMAN BODY (VIEWED FROM ABOVE)
DETECTION RESULT OF HUMAN DETECTION SENSOR
TEMPERATURE DIFFERENCE FROM BACKGROUND TEMPERATURE
EQUAL TO OR HIGHER THAN 3°C
EQUAL TO OR HIGHER THAN 2°C
EQUAL TO OR HIGHER THAN 1°C
EQUAL TO OR LOWER THAN 1°C
DETECTION ARE A2
DETECTION ARE A1
DIFFERENCE OF EQUAL TO OR HIGHER THAN 1°C: ZERO POINT
DIFFERENCE OF EQUAL TO OR HIGHER THAN 1°C: FOUR POINTS
DIFFERENCE OF EQUAL TO OR HIGHER THAN 1°C: SIX POINTS
DIFFERENCE OF EQUAL TO OR HIGHER THAN 1°C: 15 POINTS
DIFFERENCE OF EQUAL TO OR HIGHER THAN 1°C: 29 POINTS
DIFFERENCE OF EQUAL TO OR HIGHER THAN 1°C: 28 POINTS
a b c d e f g h
1 2 3 4 5 6 7 8
ENTER DETECTION AREA
REACH POWER-SAVING RETURN DISTANCE
DIFFERENCE OF EQUAL TO OR HIGHER THAN 1°C: 57 POINTS
IN USE OF APPARATUS

| | (a) | (b) | (c) | (d) | (e) | (f) |
|---|---|---|---|---|---|---|
| A1 | 0 | 1 | 10 | 13 | 15 | 28 |
| A2 | 0 | 0 | 2 | 4 | 6 | 29 |
| T | – | 0 | 3 | 4 | 5 | 7 |

*A1/A2 INDICATES THE NUMBER OF ELEMENTS (Δ OF EQUAL TO OR HIGHER THAN 1°C FROM BACKGROUND TEMPERATURE) IN EACH DETECTION AREA, AND T INDICATES TIME AFTER INITIAL DETECTION OF Δ OF EQUAL TO OR HIGHER THAN 1°C BY ELEMENT.

| | (a) | (b) | (c) | (d) | (e) | (f) |
|---|---|---|---|---|---|---|
| V | 0 | 0.5 | 2 | 2.5 | 3 | 4 |
| T | – | 0 | 3 | 4 | 5 | 7 |

*V INDICATES DETECTED VOLTAGE OF REFLECTED LIGHT, AND T INDICATES TIME AFTER DETECTION OF VOLTAGE OF V = 0.5V

IMAGE FORMING APPARATUS

BACKGROUND OF THE INVENTION

Field of the Invention

The present invention relates to an image forming apparatus using, e.g., an electrophotographic method.

Description of the Related Art

Typically in an image forming apparatus using, e.g., an electrophotographic method, preparatory operation is sometimes started in anticipation of a start-up time of the device in a case where an operator has operated an operation portion provided at the image forming apparatus, for example. Moreover, there is a method in which for further power saving, a human detection sensor is provided at the image forming apparatus (Japanese Patent Laid-Open No. 2012-114500 and Japanese Patent Laid-Open No. 2012-118253).

Japanese Patent Laid-Open No. 2012-114500 discloses that for the purpose of improving reliability in discrimination on whether or not a movable body detected by a human detection sensor is an operator of an image forming apparatus, part of a detection surface of the human detection sensor is blocked so that a detection direction, a detection region, the shape (the outline) of the detection region, etc. can be adjusted.

Japanese Patent Laid-Open No. 2012-118253 discloses that for the purpose of ensuring both of energy saving performance and convenience, sensitivity of a human detection sensor can be adjusted based on actual performance on whether switching from a power-saving mode to a normal mode is performed according to a detection result of the human detection sensor or operation by an operator.

Generally, a certain start-up time is necessary for starting up an image forming apparatus to an image formable state. For this reason, response sensitivity of a human detection sensor is, in anticipation of the start-up time, preferably set such that a waiting time until the image forming apparatus is brought into the image formable state after an operator has reached the image forming apparatus is shortened as much as possible.

However, in a case where the image forming apparatus is placed in lower-temperature environment than expected environment, the start-up time might be longer than expected, and the waiting time until the image forming apparatus is brought into the image formable state after the operator has reached the image forming apparatus might be longer than a normal waiting time.

SUMMARY OF THE INVENTION

The present invention relates to an image forming apparatus having the following components: an image forming portion including a rotatable photosensitive body, a rotor configured to scan the photosensitive body with laser light from a laser light source, and a motor configured to rotatably drive the rotor and configured to perform image formation for a recording member; a power source configured to output power for rotatably driving the motor; a human body detection sensor configured to detect a human body in a predetermined region for the image forming apparatus, a signal according to a distance between the human body and the human body detection sensor being output from the human body detection sensor; a temperature sensor configured to detect the temperature of the image forming apparatus; a supply portion configured to supply, as preparation for the image formation, the power to the motor based on comparison between the signal output and a threshold in a state in which no power is supplied to the motor; and a changing portion configured to change at least one of the signal output and the threshold such that the distance upon the start of supply of the power from the supply portion is longer in a case where a detection temperature of the temperature sensor is a first temperature than in a case where the detection temperature is a second temperature higher than the first temperature.

Further features of the present invention will become apparent from the following description of exemplary embodiments (with reference to the attached drawings).

BRIEF DESCRIPTION OF THE DRAWINGS

FIGS. 3A to 3C are schematic views for describing a detection result of the human detection sensor.

DESCRIPTION OF THE EMBODIMENTS

An image forming apparatus of the present invention will be described below in more detail with reference to the drawings.

First Reference Example

1. Entire Configuration of Image Forming Apparatus

Figure 1:
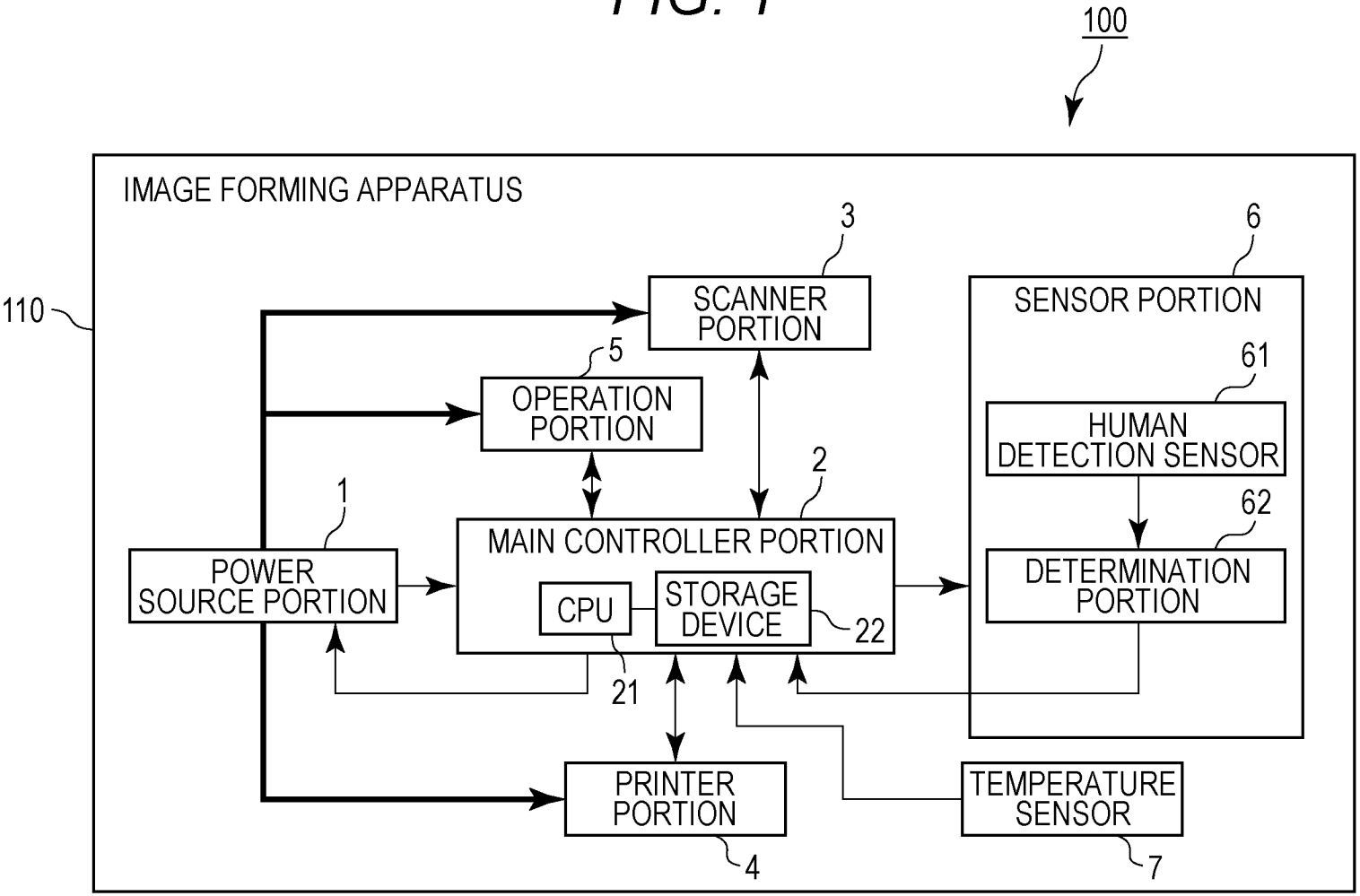
FIG. 1 is a block diagram of an image forming apparatus.

FIG. 1 is a block diagram of an image forming apparatus 100 of the present reference example. In the present reference example, the image forming apparatus 100 is a multi-function machine configured to form an image by means of an electrophotographic method and having the functions of a copy machine, a printer, and a fax machine.

The image forming apparatus 100 has, in a main body 110 thereof, a power source portion 1, a main controller portion 2, a scanner portion 3, a printer portion 4, an operation portion 5, a sensor portion 6, and a temperature sensor 7.

In the present reference example, the power source portion 1 is configured to supply power from a power source (not shown) as a commercial power source to at least one power supply target of the image forming apparatus 100. The main controller portion 2 has a CPU 21 as an arithmetic control unit, a hard drive (a magnetic disk) as a storage unit, and a storage device 22 including a RAM, a ROM, etc. The main controller portion 2 is configured to cause the CPU 21 to mainly execute processing according to a program stored in the storage device 22, thereby controlling operation of each portion of the image forming apparatus 100 in an integrated manner. As will be described later in detail, the main controller portion 2 has functions as a switching portion configured to switch a power supply mode from the power source portion 1 to the power supply target and a sensitivity changing portion configured to change response sensitivity in switching of the power supply mode according to a detection result of a human detection sensor 61. For example, when the function of the copy machine of the image forming apparatus 100 is used, the scanner portion 3 is configured to optically read an image of an original document and convert the image into an electric signal, thereby sending image information to the printer portion 4. As will be described later in detail, the printer portion 4 is configured to perform image formation. The operation portion (an operation panel) 5 has functions as an input unit for inputting, e.g., an instruction on image formation to the main controller portion 2 by an operator such as a user or a service representative and a display unit configured to display information for the operator under control of the main controller portion 2.

The sensor portion 6 has the human detection sensor 61 and a determination portion 62. The human detection sensor 61 may be configured to identify and detect a movable body as a person, but is not limited to such a configuration. That is, the human detection sensor 61 may be a movable body sensor configured to detect the movable body approaching the image forming apparatus 100, the movable body including the operator approaching the image forming apparatus 100 to operate the image forming apparatus 100. As will be described later in detail, the determination portion 62 is configured to determine, based on the detection result of the human detection sensor 61, whether or not the power supply mode is to be switched. In the present reference example, the temperature sensor 7 as a temperature detection unit is arranged in the vicinity of a fixing film 46*a* (FIG. 4) of a later-described fixing device 46 provided at the printer portion 4 (the temperature sensor 7 may be arranged in contact with the fixing film 46*a*), thereby detecting the temperature of the fixing film 46*a*.

In the present reference example, the image forming apparatus 100 is switchable between at least two power supply modes including a normal mode (a first mode) upon execution of copy operation etc. and a power-saving mode (a second mode) with power consumption less than that of the normal mode. In a case where the image forming apparatus 100 is not used even after a lapse of a certain time, the main controller portion 2 as the switching portion controls the power source portion 1 to switch the power supply mode from the normal mode to the power-saving mode. In the power-saving mode, power supply to the scanner portion 3 and the printer portion 4 is stopped, and power supply to part of the inside of the main controller portion 2 and part of the inside of the operation portion 5 is stopped. In the power-saving mode, power is supplied from the power source portion 1 to the sensor portion 6 via the main controller portion 2. In the present reference example, power is constantly supplied to the human detection sensor 61 of the sensor portion 6. Moreover, in the present reference example, power is also constantly supplied to the determination portion 62 of the sensor portion 6. On this point, power supply to the determination portion 62 may be stopped as necessary, but it is configured to promptly supply power to the determination portion 62 in a case where predetermined reaction is detected by the human detection sensor 61. The determination portion 62 processes the detection result of the human detection sensor 61 to determine the presence of the operator, thereby outputting an energization request signal to the main controller portion 2 according to a determination result. When receiving the energization request signal, the main controller portion 2 as the switching unit controls the power source portion 1 to switch the power supply mode from the power-saving mode to the normal mode. The details of determination processing performed by the determination portion 62 will be described later.

Note that power may be directly supplied from the power source portion 1 to the sensor portion 6, and the energization request signal output from the determination portion 62 may be directly given to the power source portion 1.

2. Configuration of Human Detection Sensor (Infrared Array Sensor)

Next, the configuration of the human detection sensor 61 in the present reference example will be described. In this example, a side closer to a surface of the image forming apparatus 100 on which the operation portion 5 provided outside the main body 110 is arranged is a "front (front face)" side, and the opposite side thereof is a "back (rear face)" side. Moreover, as viewed from the front side of the image forming apparatus 100, a left side is a "left" side, and a right side is a "right" side. In the present reference example, the image forming apparatus 100 has, as viewed from above, such a substantially rectangular shape that a front surface and a back surface are substantially parallel with each other and a left surface and a right surface are substantially parallel with each other.

Figure 2A:
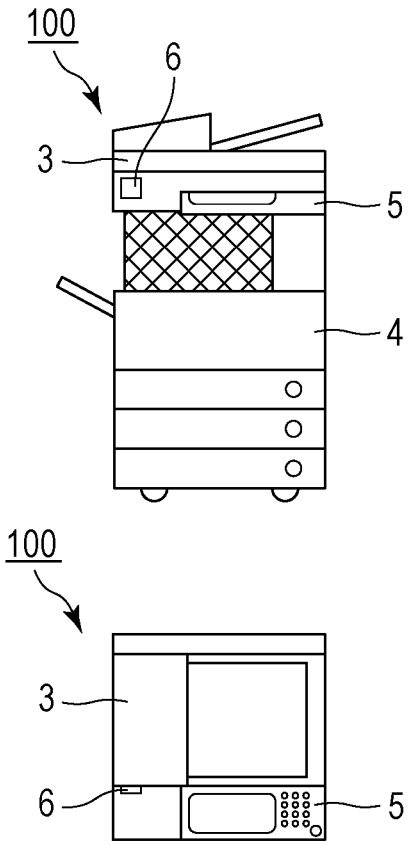
FIGS. 2A and 2B are schematic views for describing a detection area of a human detection sensor.
Figure 2B:
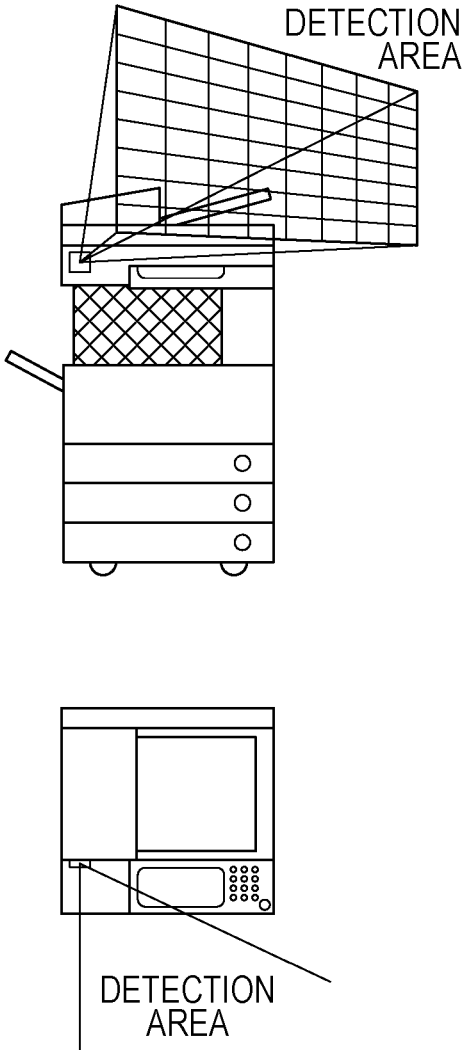

FIGS. 2A and 2B are schematic views for describing a region (also referred to as a "detection area" in this example) where the human detection sensor 61 in the present reference example can detect a human body as the movable body. A schematic view of an outer appearance of the image forming apparatus 100 from the front side is on an upper side of FIG. 2A, and a schematic view of the outer appearance of the image forming apparatus 100 from above is on a lower side of FIG. 2A. Moreover, views on upper and lower sides of FIG. 2B are each similar to those on the upper and lower sides of FIG. 2A illustrated together with the detection area of the human detection sensor 61.

The image forming apparatus 100 of the present reference example has an infrared array sensor as the human detection sensor 61. The infrared array sensor 61 has multiple infrared sensors (infrared light receiving elements (hereinafter also simply referred to as "elements")) arranged in a matrix of N (N is an integer of two or more)×N. The infrared array sensor 61 is configured to receive, by each element arranged in the matrix, infrared light emitted from a heat source, thereby outputting a signal according to a temperature value detected by each element. Thus, the infrared array sensor 61 is used so that the shape of the heat source can be detected as temperature distribution. In the present reference example, the presence of the person approaching the image forming apparatus 100 is determined based on a temperature change between a background temperature in the case of the absence of the person and the body temperature of the person in the case of the presence of the person. For accurately detecting the temperature of the human body, the temperature of an exposed portion of the skin of the human body is preferably detected. Thus, in the present reference example, the detection area of the infrared array sensor 61 is set to a forward direction from the main body 110 of the image forming apparatus 100 and an obliquely-upward direction with respect to the horizontal direction. With this configuration, the detection area of the infrared array sensor 61 is set so that the temperature of the face of the operator (the human body) approaching the image forming apparatus 100 to operate the image forming apparatus 100 (specifically the operation portion 5 in the present reference example) can be mainly detected.

FIGS. 3A to 3C are schematic views for describing the detection result of the infrared array sensor 61 according to a distance between the image forming apparatus 100 and the human body. A positional relationship between the image forming apparatus 100 and the human body as viewed from the right side is illustrated on an upper side of each of FIGS. 3A to 3C. Moreover, a positional relationship between the image forming apparatus 100 and the human body as viewed from above is illustrated on the middle of each of FIGS. 3A to 3C. Further, the detection result of the infrared array sensor 61 in the positional relationships between the image forming apparatus 100 and the human body as illustrated on the upper side and the middle is illustrated on a lower side of each of FIGS. 3A to 3C.

In the infrared array sensor 61 of the present reference example, 64 elements in total are arranged in eight lines 1 to 8 and eight columns a to h as illustrated on the lower sides of FIGS. 3A to 3C. In description below, in a case where the position of each element of the infrared array sensor 61 is specified, the position is described with the number of the line of the element and the numeral of the column, such as the elements 1a to 8h.

FIG. 3A illustrates the positional relationship between the image forming apparatus 100 and the human body and the detection result of the infrared array sensor 61 right after the human body has entered the detection area of the infrared array sensor 61. In the state of FIG. 3A, the infrared array sensor 61 detects the heat source at several lower elements such as the elements 1c, 1d, 1e, 2d. FIG. 3B illustrates the positional relationship between the image forming apparatus 100 and the human body and the detection result of the infrared array sensor 61 in a case where the human body more approaches the image forming apparatus 100 as compared to the state of FIG. 3A. In the state of FIG. 3B, the elements of the infrared array sensor 61 detecting the heat source expand in an upward direction from the first line of the elements to the sixth line of the elements, as well as expanding in a right-to-left direction from the column d to the columns b and g. FIG. 3C illustrates the positional relationship between the image forming apparatus 100 and the human body and the detection result of the infrared array sensor 61 in a case where the human body much more approaches the image forming apparatus 100 as compared to the state of FIG. 3B and reaches such a position that the human body (the operator) can operate the image forming apparatus 100. In the state of FIG. 3C, the infrared array sensor 61 detects the heat source from most of the elements.

In the present reference example, the detection area of the infrared array sensor 61 is divided into at least the following two detection areas as illustrated on the middle of each of FIGS. 3A to 3C. A first one is a first detection area A1 where switching from the power-saving mode to the normal mode is not performed even when the person is present. A second one is a second detection area A2 where switching from the power-saving mode to the normal mode is performed in a case where a predetermined condition is satisfied when the person is present. As illustrated on the lower side of each of FIGS. 3A to 3C, an element group below a thick line in the figure is, in the infrared array sensor 61, an element group for detecting the human body in the first detection area A1, and an element group above the thick line is an element group for detecting the human body in the second detection area A2. Note that for the sake of convenience, each element of the infrared array sensor 61 in the element group below the thick line in the figure will be sometimes referred to as the "first detection area A1," and each element of the infrared array sensor 61 in the element group above the thick line will be sometimes referred to as the "second detection area A2." In the present reference example, it is determined, based on the number of elements (the distance between the image forming apparatus 100 and the human body) detecting a temperature difference of equal to or higher than 1° C. from the background temperature in the second detection area A2 and a continuous detection time (a dwell time), whether or not switching from the power-saving mode to the normal mode is to be performed.

As described above, in the present reference example, the human detection sensor 61 as the movable body sensor has multiple detection portions, and the multiple detection portions are configured such that the number of detection portions detecting the movable body increases as the movable body approaches the image forming apparatus 100. Specifically, in the present reference example, the human detection sensor 61 is the infrared array sensor including multiple thermosensitive portions as the multiple detection portions. Moreover, as will be described later in detail, the determination portion 62 causes, in the present reference example, the switching portion to switch the power supply mode from the power-saving mode to the normal mode based on a comparison result between the detection result of the human detection sensor 61 and a predetermined threshold for switching the power supply mode. Further, the sensitivity changing portion configured to change the response sensitivity in switching of the power supply mode according to the detection result of the human detection sensor 61 changes the threshold to change the sensitivity. Specifically, in the present reference example, the determination portion 62 causes the switching portion to switch the power supply mode in a case where the movable body is detected by equal to or greater than a predetermined number of detection portions as the threshold. In addition, in the present reference example, the sensitivity changing portion more decreases the above-described predetermined number in a case where the temperature detected by the temperature sensor 7 is a second temperature lower than a first temperature than in a case where the temperature detected by the temperature sensor 7 is the first temperature. In the present reference example, the main controller portion 2 has the functions as the switching portion and the sensitivity changing portion as described above.

3. Configuration and Operation of Printer Portion

Figure 4:
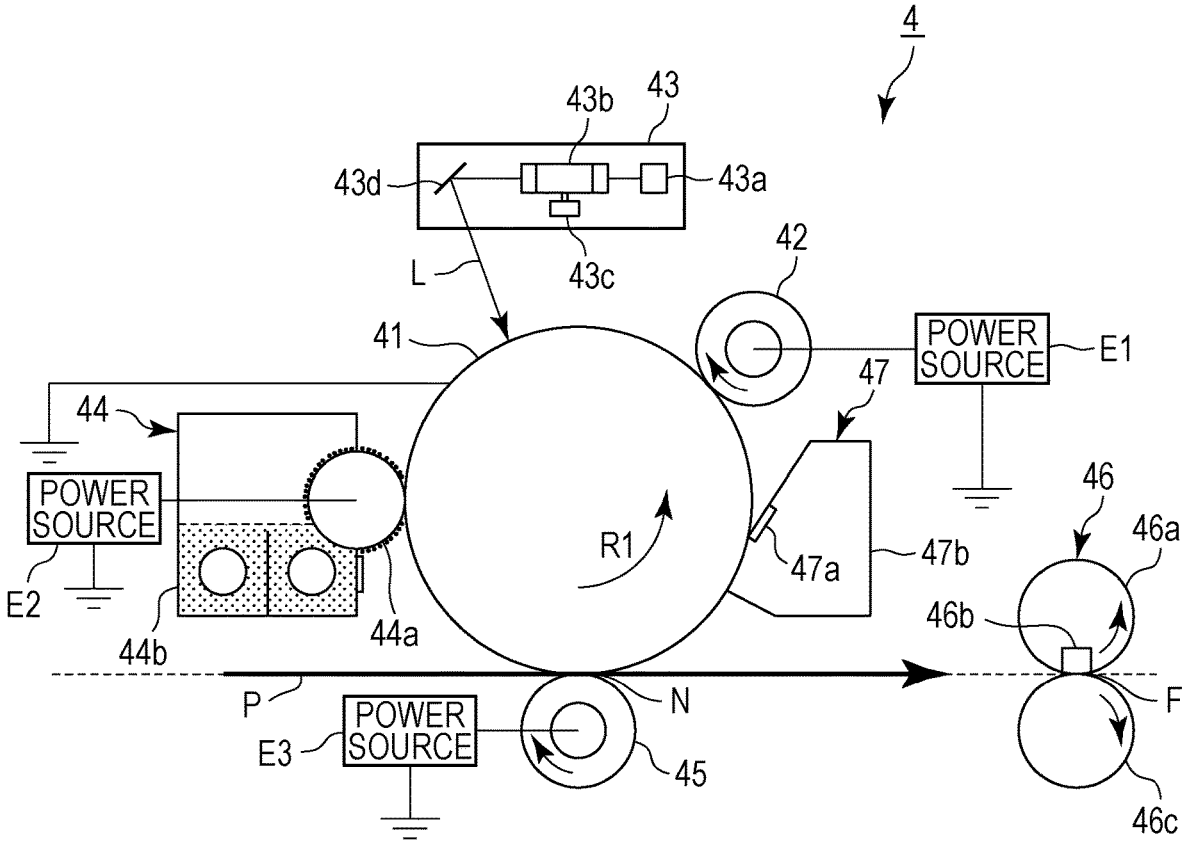
FIG. 4 is a schematic sectional view of an outline configuration of a printer portion.

Next, the printer portion 4 in the present reference example will be described. FIG. 4 is a schematic sectional view of an outline configuration of the printer portion 4 in the present reference example.

The printer portion 4 has a photosensitive drum 41 as a drum-shaped (cylindrical) electrophotographic photosensitive body (photosensitive body) rotatable as an image carrier. In the present reference example, the photosensitive drum 41 is an organic photo conductor (OPC) exhibiting negative chargeability as charging characteristics. The photosensitive drum 41 is rotatably driven in the direction of an arrow R1 in the figure by a drum drive motor (not shown) as a drive source. For a surface of the rotating photosensitive drum 41, charging processing with a predetermined polarity (a negative polarity in the present reference example) and a predetermined potential is uniformly performed by a charging roller 42 as a roller-shaped charging member as a charging unit. The charging roller 42 is arranged in contact with the surface of the photosensitive drum 41. The charging roller 42 charges the surface of the photosensitive drum 41 by electric discharge generated in a tiny air gap (gap) between the charging roller 42 and the photosensitive drum 41. At a charging step, a charging voltage (a charging bias) containing a DC voltage component with the predetermined polarity (the negative polarity in the present reference example) is applied from a charging power source E1 to the charging roller 42.

For the surface of the photosensitive drum 41 subjected to the charging processing, scanning exposure is performed by an exposure device 43 as an exposure unit. An electrostatic image (an electrostatic latent image) is formed on the photosensitive drum 41. In the present reference example, the exposure device 43 is a laser beam scanner. The exposure device 43 has a semiconductor laser 43*a* as a light source, a rotatable polygon mirror 43*b* (a rotor), a polygon motor 43*c* as a drive source configured to rotate the polygon mirror 43*b*, and a reflecting mirror 43*d* configured to reflect a laser beam toward the photosensitive drum 41, for example. The exposure device 43 is configured to output laser light L modulated according to an image signal sent from a host processing device such as the scanner portion 3 (FIG. 1) to the main controller portion 2, thereby performing scanning exposure for the surface of the rotating photosensitive drum 41. That is, the exposure device 43 irradiates the rotating polygon mirror (a polygonal mirror) 43*b* with the laser beam, thereby performing exposure of the photosensitive drum 41 during scanning with the laser light L in parallel substantially with a rotational axis direction of the photosensitive drum 41. By such scanning exposure, an absolute value of the potential of the surface portion of the photosensitive drum 41 irradiated with the laser light L decreases, and accordingly, the electrostatic image according to the image information is formed on the surface of the photosensitive drum 41.

The electrostatic image formed on the photosensitive drum 41 is developed (visualized) using a developer by a development device 44 as a development unit, and a toner image is formed on the photosensitive drum 41. In the present reference example, the development device 44 uses a two-component developer containing toner (non-magnetic toner particles) as the developer and a carrier (magnetic carrier particles). The development device 44 has a developing sleeve 44*a* as a developer carrier configured to carry the developer to convey the developer to a portion facing the photosensitive drum 41, and a developer container 44*b* configured to house the developer, for example. The developing sleeve 44*a* carries and conveys the developer by a magnetic field generated by a magnet roll as a magnetic field generation unit arranged in a hollow portion of the developing sleeve 44*a*. Moreover, the developing sleeve 44*a* causes, by developer nap caused by the magnetic field generated by the magnet roll, a magnetic brush formed on the developing sleeve 44*a* to contact the surface of the photosensitive drum 41. Moreover, at a development step, a development voltage (a development bias) containing a DC voltage component with the predetermined polarity (the negative polarity in the present reference example) is applied from a development power source E2 to the developing sleeve 44*a*. Accordingly, the toner selectively adheres from the magnetic brush to the surface of the photosensitive drum 41 according to the electrostatic image, and the electrostatic image is developed as the toner image. In the present reference example, the toner charged with the same polarity (the negative polarity in the present reference example) as the charging polarity of the photosensitive drum 41 adheres to the exposure portion on the photosensitive drum 41, the absolute value of the potential having decreased in the exposure portion by exposure after the charging processing had been uniformly performed (reversal developing method).

A transfer roller 45 which is a roller-shaped transfer member as a transfer unit is arranged facing the photosensitive drum 41. The transfer roller 45 is pressed against the surface of the photosensitive drum 41 with a predetermined pressing force, thereby forming a transfer portion (a pressing nip portion) N at which the photosensitive drum 41 and the transfer roller 45 contact each other. The toner image formed on the photosensitive drum 41 is, at the transfer portion N, transferred to a recording member (a recording medium, a transfer member, and a sheet) P, such as paper conveyed with the paper being pinched between the photosensitive drum 41 and the transfer roller 45, by action of the transfer roller 45. At a transfer step, a transfer voltage (a transfer bias) as a DC voltage with the opposite polarity of the charging polarity (the regular charging polarity) of the toner upon development is applied from a transfer power source E3 to the transfer roller 45. The recording member P is, by a recording member supply/conveying mechanism (not shown), supplied to the transfer portion N in timing with the toner image on the photosensitive drum 41.

The recording member P onto which the toner image has been transferred is separated from the surface of the photosensitive drum 41, and is conveyed to the fixing device 46 which is a heating device as a fixing unit. In the present reference example, the fixing device 46 is a surf fixing device 46. The surf fixing device 46 has the fixing film 46*a* made of a cylindrical heat-resistant resin film as a heating member, a ceramic heater 46*b* as a heater arranged on an inner peripheral side of the fixing film 46*a*, and a pressing roller 46*c* as a pressing member, for example. The pressing roller 46*c* is pressed against the ceramic heater 46*b* through the fixing film 46*a* with a predetermined pressing force, thereby forming a fixing portion (a pressing nip portion) F at which the fixing film 46*a* and the pressing roller 46*c* contact each other. The fixing film 46*a* is pinched between the ceramic heater 46*b* and the pressing roller 46*c*, and orbitally moves (rotates) by rotary driving of the pressing roller 46*c*. The recording member P on which the unfixed toner image is carried is guided into the fixing portion F, and is conveyed together with the fixing film 46*a*. Thus, heat of the ceramic heater 46*b* is, at the fixing portion F, provided to the recording member P through the fixing film 46*a*, and the pressing force is provided to the recording member P by the pressing roller 46*c*. In this manner, the toner image is fixed (melted and fixed) onto the surface. Note that the fixing device 46 is at least one of the power supply targets of the power source portion 1, and power is supplied in the normal mode and is not supplied in the power-saving mode.

The recording member P subjected to toner image fixing processing is discharged (output) as an image-formed matter (a print, a copy) to the outside of the main body 110 of the image forming apparatus 100. Moreover, the toner (transfer residual toner) remaining on the surface of the photosensitive drum 41 at the transfer step is removed and collected from the surface of the photosensitive drum 41 by a cleaning device 47 as a cleaning unit. The cleaning device 47 uses a cleaning blade 47*a* as a cleaning member arranged in contact with the surface of the photosensitive drum 41, thereby scraping off the transfer residual toner from the surface of the rotating photosensitive drum 41 and housing the toner in a cleaning container 47*b*.

In this example, driving of the printer portion 4, voltage application to each power source E1, E2, E3, processing of the image information, etc. are controlled by the main controller portion 2 (FIG. 1).

Note that the configuration of the printer portion 4 is not limited to the configuration of the present reference example. For example, the configuration in which the toner image is directly transferred from the photosensitive drum to the recording member is not employed, but a configuration in which a toner image is primarily transferred from a photosensitive drum to an intermediate transfer member and is secondarily transferred from the intermediate transfer member to a recording member may be employed.

4. Problems in Low-Temperature State (Fixing Temperature Adjustment)

In the present reference example, when the human detection sensor 61 detects, in the power-saving mode, that the operator approaches the image forming apparatus 100, the power-saving mode is switched to the normal mode, and power supply to the printer portion 4 begins.

Specifically, in a case where the image forming apparatus is used at an office, it is demanded that a waiting time is reduced as much as possible upon power application or returning from the power-saving mode. For this reason, in the present reference example, the surf fixing type fixing device with a relatively-short start-up time is used. In the surf fixing type fixing device, the heat capacity of the heating member is smaller than that of a roller heating type fixing device. Thus, the surf fixing type fixing device has such characteristics that a time until the temperature of the heater increases to a heating target heatable temperature after the start of energization to the heater is short. With such characteristics, almost no waiting time due to an increase in the temperature of the fixing device is caused even when energization to the fixing device begins in a case where a print signal is received by the image forming apparatus or the operator operates the operation portion. That is, the fixing device can reach a usable temperature (such a temperature that the recording member P on which the toner image is carried is heatable) with almost no waiting time after the start of energization to the fixing device. Moreover, in a case where the image forming apparatus has the power-saving mode as in the present reference example, even when energization to the fixing device begins after switching from the power-saving mode to the normal mode, almost no waiting time due to an increase in the temperature of the fixing device is caused in many cases.

However, even in the case of using a surf fixing method, it might take time to increase the temperature of the fixing device in low-temperature environment. Thus, in the low-temperature environment, a time until image formation becomes available after switching from the power-saving mode to the normal mode has been performed and power supply to the printer portion 4 has begun might be increased.

For this reason, in the present reference example, the response sensitivity in switching from the power-saving mode to the normal mode according to the detection result of the human detection sensor 61 is increased in a case where the temperature of the fixing film 46*a* detected by the temperature sensor 7 is lower than a predetermined value. In the present reference example, the main controller portion 2 as the sensitivity changing portion executes such processing. Specifically, in the present reference example, the main controller portion 2 changes a specified value G (described later) for the number of elements having detected the heat source in the second detection area of the human detection sensor 61, the specified value G being used for determination by the determination portion 62 on whether or not switching from the power-saving mode to the normal mode is to be performed. More specifically, in the present reference example, in a case where the temperature of the fixing film 46*a* detected by the temperature sensor 7 is lower than 10° C., the main controller portion 2 decreases the specified value G as compared to that in a case where such a temperature is equal to or higher than 10° C. The specified value G is stored in advance in the storage device 22 of the main controller portion 2 in association with each temperature range as described above. The CPU 21 of the main controller portion 2 updates the specified value G held in the storage portion of the determination portion 62, thereby changing the specified value G.

As described above, in a case where the movable body approaches the image forming apparatus 100, the main controller portion 2 changes, based on the detection result of the temperature sensor 7, the response sensitivity in switching from the power-saving mode to the normal mode by the determination portion 62 based on the detection result of the human detection sensor 61. Moreover, the main controller portion 2 more increases the sensitivity in a case where the temperature detected by the temperature sensor 7 is the second temperature lower than the first temperature than in a case where the temperature detected by the temperature sensor 7 is the first temperature. Note that in the present reference example, the main controller portion 2 functions as the sensitivity changing portion configured to execute sensitivity changing processing, but the sensor portion 6 may include the sensitivity changing portion configured to execute the sensitivity changing processing.

5. Control Procedure

Figure 5:
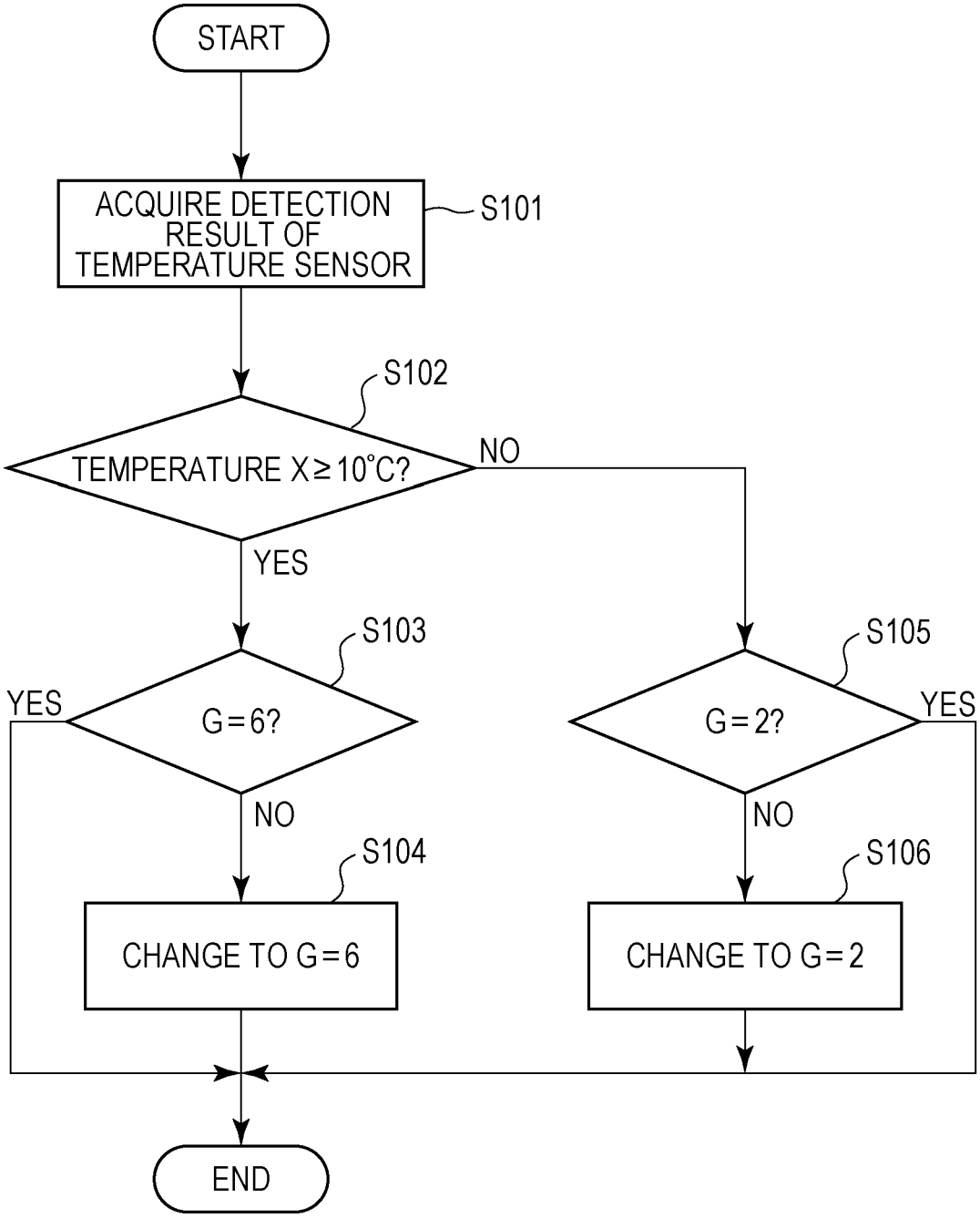
FIG. 5 is a flowchart of sensitivity changing processing.

Next, the sensitivity changing processing performed by the main controller portion 2 will be described. FIG. 5 is a flowchart of the outline of the procedure of the sensitivity changing processing in the present reference example. This sensitivity changing processing may be regularly executed in the power-saving mode, or may be executed right before execution of the processing of S206 in the later-described procedure of FIG. 6.

The main controller portion 2 acquires a temperature X detected by the temperature sensor 7 (S101), and determines whether or not the temperature X is equal to or higher than 10° C. (S102). In a case where the main controller portion 2 determines, at S102, that the temperature X is equal to or higher than 10° C., the main controller portion 2 determines whether or not the specified value G held in the storage portion of the determination portion 62 is "6" (S103). Then, in a case where the main controller portion 2 determines as not being "6" at S103, the main controller portion 2 changes the specified value G held in the storage portion of the determination portion 62 to "6" (S104). In a case where the main controller portion 2 determines as being "6" at S103, the processing ends. In a case where the main controller portion 2 determines, at S102, that the temperature X is not equal to or higher than 10° C. (lower than 10° C.), the main controller portion 2 determines whether or not the specified value G held in the storage portion of the determination portion 62 is "2" (S105). In a case where the main controller portion 2 determines as not being "2" at S105, the main controller portion 2 changes the specified value G held in the storage portion of the determination portion 62 to "2" (S106). In a case where the main controller portion 2 determines as being "2" at S105, the processing ends.

Figure 6:
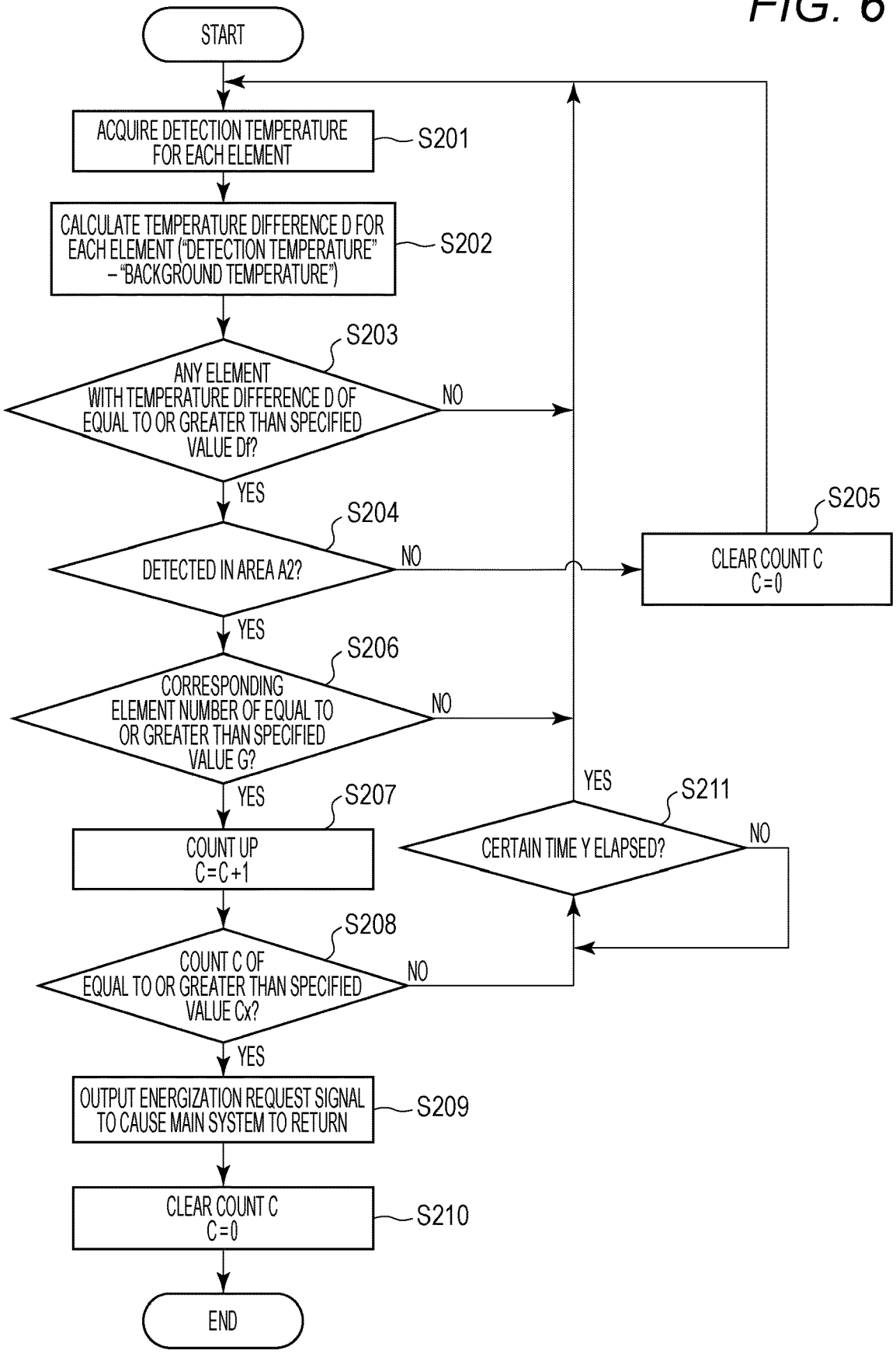
FIG. 6 is a flowchart of power supply determining processing.

Next, the processing of determining switching of the power supply mode by the determination portion 62 will be described. FIG. 6 is a flowchart of the outline of the procedure of the determination processing in the present reference example. This determination processing is substantially constantly executed in the power-saving mode.

The determination portion 62 acquires the temperature detected by each element of the human detection sensor 61 (S201). Subsequently, the determination portion 62 calculates a difference (a temperature difference) D between the temperature (the background temperature) detected by each element in a case where no person is present in the first and second detection areas A1, A2 and the temperature detected by each element (S202). The background temperature is held in the storage portion of the determination portion 62. Subsequently, the determination portion 62 determines whether or not there is any element with a calculated difference D of equal to or greater than a specified temperature difference Df (S203). In the present reference example, the specified temperature difference Df is 1° C., and is held in the storage portion of the determination portion 62.

In a case where the determination portion 62 determines, at S203, that there is no element with a temperature difference D of equal to or greater than the specified temperature difference Df, the processing returns to S201. Note that in a case where the determination portion 62 determines, at S203, that there is no element with a temperature difference D of equal to or greater than the specified temperature difference Df, the determination portion 62 may again acquire the temperature detected by each element, and may again register such a temperature as the background temperature in the storage portion of the determination portion 62. In a case where the determination portion 62 determines, at S203, that there are elements with a temperature difference D of equal to or greater than the specified temperature difference Df, the determination portion 62 determines whether or not these corresponding elements are within the second detection area A2 (S204).

In a case where the determination portion 62 determines, at S204, that the corresponding elements are within the second detection area A2, the determination portion 62 determines whether or not the number of corresponding elements in the second detection area A2 is equal to or greater than the specified value G (S206). The specified value G is held in the storage portion of the determination portion 62. In the present reference example, the specified value G is set to "6" as described above in a case where the temperature X detected by the temperature sensor 7 is equal to or higher than 10° C. Only in a case where six or more corresponding elements are continuously detected, the determination portion 62 determines that the number of corresponding elements is equal to or greater than the specified value G. On the other hand, the specified value G is, as described above, set to "2" in the present reference example in a case where the temperature detected by the temperature sensor 7 is lower than 10° C. Only in a case where two or more corresponding elements are continuously detected, the determination portion 62 determines that the number of corresponding elements is equal to or greater than the specified value G.

In a case where the determination portion 62 determines, at S206, that the number of corresponding elements is equal to or greater than the specified value G, the determination portion 62 increments a count value C (S207). The count value C is held in the storage portion of the determination portion 62. Subsequently, the determination portion 62 determines whether or not the count value C is equal to or greater than a specified count value Cx (S208). In the present reference example, the specified count value Cx is 5, and is held in the storage portion of the determination portion 62. In a case where the determination portion 62 determines, at S208, that the count value C is equal to or greater than the specified count value Cx, the determination portion 62 outputs the energization request signal, thereby causing the main controller portion 2 to switch the power supply mode from the power-saving mode to the normal mode (S209). In this manner, power supply to a main system such as the printer portion 4 including the fixing device 46 begins. Then, the determination portion 62 clears the count value C to 0 (S210).

In a case where the determination portion 62 determines, at S208, that the count value C is not equal to or greater than the specified count value Cx (the count value C is less than the specified count value Cx), the processing returns to S201 after a lapse of a certain time Y (S211). In the present reference example, the certain time Y is 0.1 seconds, and is held in the storage portion of the determination portion 62. The certain time Y is an update time of the detection result of the human detection sensor 61. An optional value can be set as the value of the certain time Y according to, e.g., a desired response speed of the human detection sensor 61. Alternatively, the value of the certain time Y may be changed (selected) as necessary by the operator according to, e.g., the desired response speed of the human detection sensor 61.

In a case where the determination portion 62 determines, at S204, that the corresponding elements are not within the second detection area A2, the determination portion 62 clears the count value C to 0 (S205). This case includes a case where the heat source is no longer detected in the second detection area A2 before the count value C reaches the specified count value Cx. The reason for clearing the count value C to 0 is that the heat source is no longer detected in the second detection area A2 in a case where the person as the heat source moves out of the second detection area A2. As described above, in the present reference example, the specified count value Cx is 5. Moreover, as described above, the certain time Y is 0.1 seconds. That is, in a case where the person stays in the second detection area A2 for equal to or longer than 0.5 seconds, such a person is determined as the operator approaching the image forming apparatus 100 to operate the image forming apparatus 100. The specified count value Cx can be set to an optional value according to installation environment of the image forming apparatus 100 or user's operating conditions. Alternatively, the specified count value Cx may be changed (selected) as necessary by the operator according to the installation environment of the image forming apparatus 100 or the user's operating conditions.

Note that in the present reference example, the temperature threshold for determination on the low-temperature environment is "10° C.," and the specified value G is "6 (in the case of equal to or higher than 10° C.)" or "2 (in the case of lower than 10° C.)." However, the temperature threshold and the specified value G as described above are not limited to the values of the present reference examples, and can be set to optional values according to the configuration of the image forming apparatus 100 or the user's operating conditions. Alternatively, at least one of the temperature threshold or the specified value G may be changed (selected) as necessary by the operator according to the installation environment of the image forming apparatus 100 or the user's operating conditions. In the present reference example, in a case where the corresponding elements equal to or greater than the specified value G are continuously detected, it is determined that there are the corresponding elements equal to or greater than the specified value G. However, even when the corresponding elements are not continuously detected, it may be determined that there are the corresponding elements equal to or greater than the specified value G.

6. Operation Example

Figure 7:
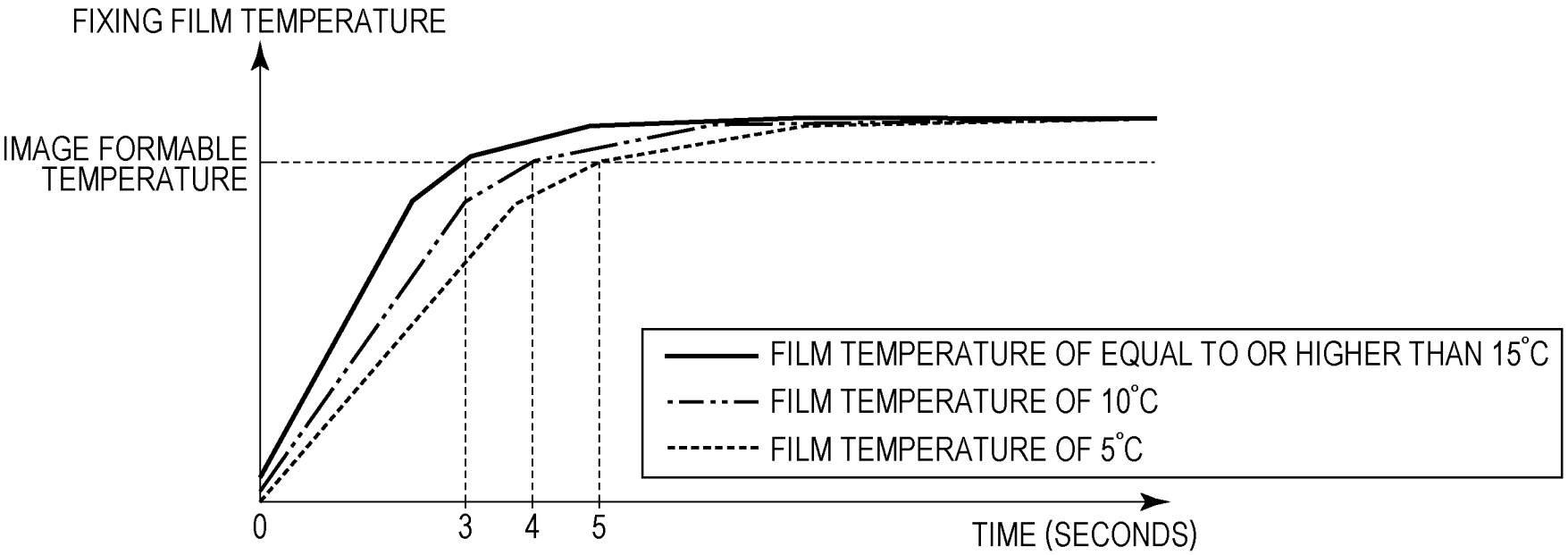
FIG. 7 is a graph for describing a start-up time of a fixing device.

FIG. 7 is a graph of a time until the temperature of the fixing film 46*a* reaches such a temperature that the fixing device 46 is usable after switching from the power-saving mode to the normal mode has been performed and power supply to the printer portion 4 including the fixing device 46 has begun. In FIG. 7, the horizontal axis indicates the time after the start of power supply to the fixing device 46, and the vertical axis indicates the temperature of the fixing film 46*a*.

In a case where the temperature of the fixing film 46*a* in the power-saving mode is equal to or higher than 15° C., the temperature of the fixing film 46*a* increases to such a temperature that the fixing device 46 is usable after a lapse of about three seconds from the start of power supply to the fixing device 46. On the other hand, in a case where the temperature of the fixing film 46*a* in the power-saving mode is 10° C., the temperature of the fixing film 46*a* increases to such a temperature that the fixing device 46 is usable after a lapse of about four seconds from the start of power supply to the fixing device 46. Moreover, in a case where the temperature of the fixing film 46*a* in the power-saving mode is 5° C., the temperature of the fixing film 46*a* increases to such a temperature that the fixing device 46 is usable after a lapse of about five seconds from the start of power supply to the fixing device 46. That is, in a case where the temperature of the fixing film 46*a* in the power-saving mode is relatively low, it takes a relatively-long time to increase the temperature of the fixing film 46*a* to such a temperature that the fixing device 46 is usable. Note that in a case where the fixing film temperature in the power-saving mode is lower than 5° C., tendency shows that it takes more time to increase the temperature of the fixing film 46*a* to such a temperature that the fixing device 46 is usable. Note that in the present reference example, in environment where the temperature of the fixing film 46*a* is lower than 5° C. in the power-saving mode, operation of the image forming apparatus 100 might be slower due to another cause such as out of warranty of hard drive operation of the main controller portion 2. Thus, description will be made herein, focusing on environment with a temperature of equal to or higher than 5° C.

Figure 8:
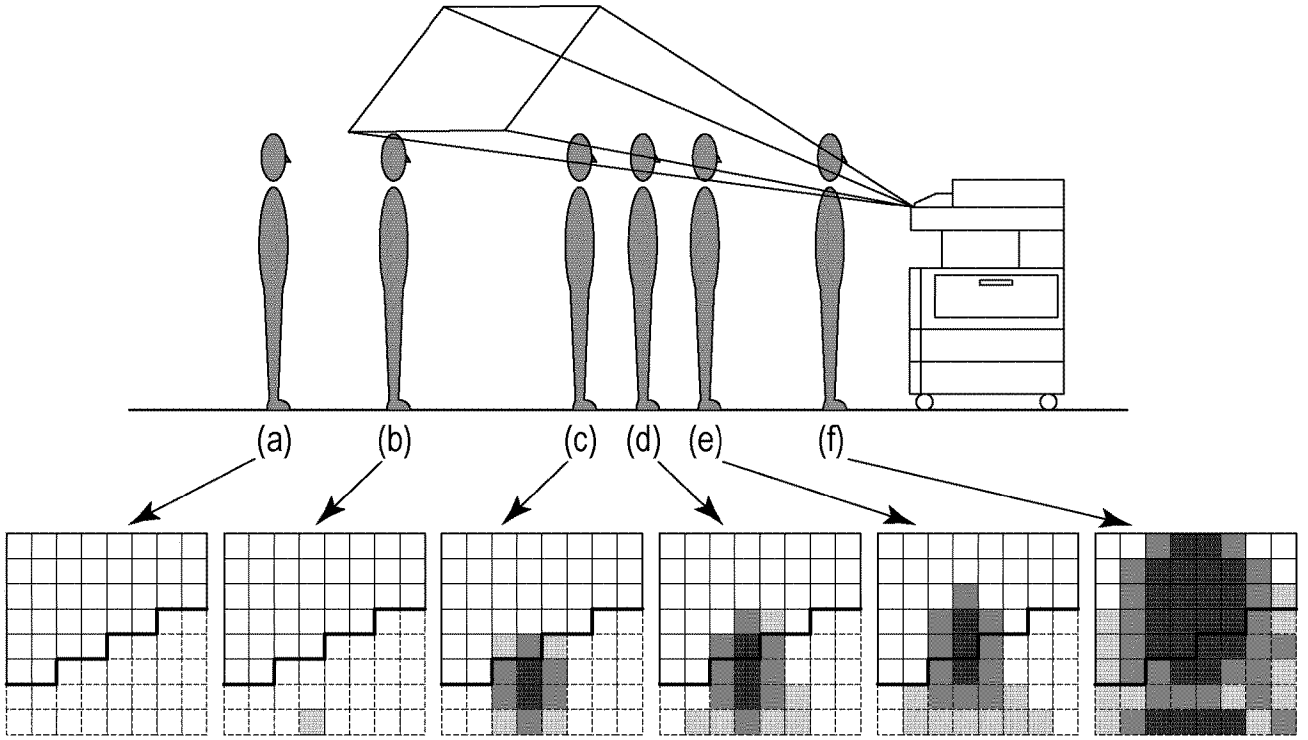
FIG. 8 is a schematic view of an example of the detection result of the human detection sensor.

FIG. 8 is a schematic view of a relationship between a situation where the operator moves to positions (a), (b), (c), (d), (e), (f) in this order to approach the image forming apparatus 100 and the element(s) of the human detection sensor 61 detecting the heat source in such a situation.

In a case where the operator is at the position (a), a significant temperature difference from the background temperature is not detected by the elements in the first detection area A1 of the human detection sensor 61, and the power supply mode is not switched. When the operator moves to the position (b), a temperature difference of equal to or higher than 1° C. from the background temperature is first detected by the element in the first detection area A1 of the human detection sensor 61. For the sake of convenience, a time point at which the operator is at the position (b) is T=0 second. Thereafter, when the operator moves to each of the positions (c), (d), (e), a temperature difference of equal to or higher than 1° C. from the background temperature is also detected by the elements in the second detection area A2 of the human detection sensor 61, and the number of such elements increases to two, four, and six. Time points at which the operator is at the positions (c), (d), (e) are each T=3 seconds, 4 seconds, and 5 seconds. Then, when the operator moves to the position (f), a temperature difference of equal to or higher than 1° C. from the background temperature is detected by most of the elements in the first and second detection areas A1, A2 of the human detection sensor 61. A time point at which the operator is at the position (f) is T=7 seconds. The operator can operate the image forming apparatus 100 via an interface such as the operation portion 5 when approaching the image forming apparatus 100 to reach the position (f). In a case where the detection result of the human detection sensor 61 is taken as a trigger to perform switching from the power-saving mode to the normal mode, it is preferable that the operator can start image formation as soon as possible after having approached the image forming apparatus 100 to operate the image forming apparatus 100 at the position (f).

Figure 9:
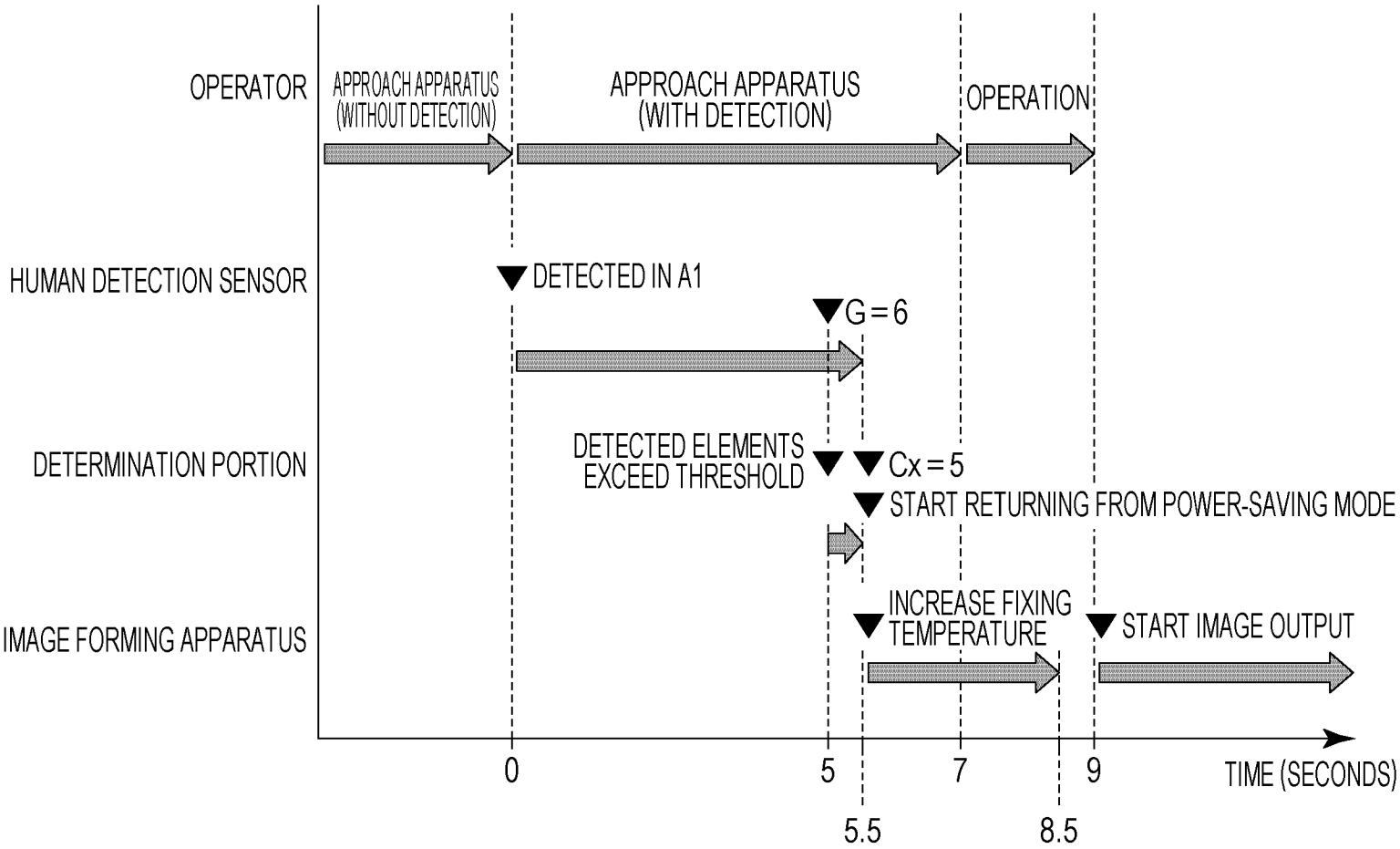
FIG. 9 is a schematic chart for describing operation in a high-temperature state in a first reference example.
Figure 10:
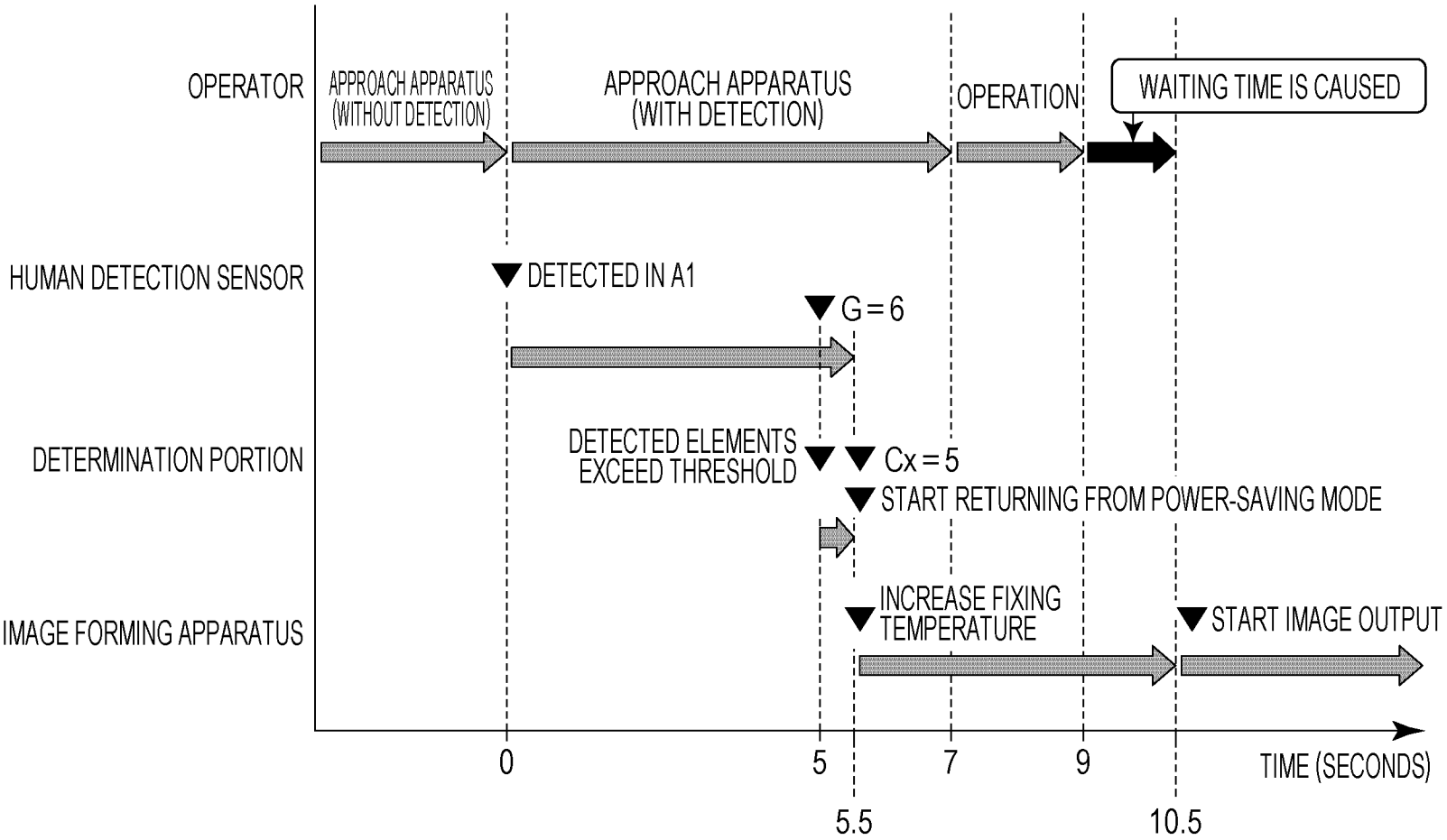
FIG. 10 is a schematic chart for describing operation in a low-temperature state in a comparative example.
Figure 11:
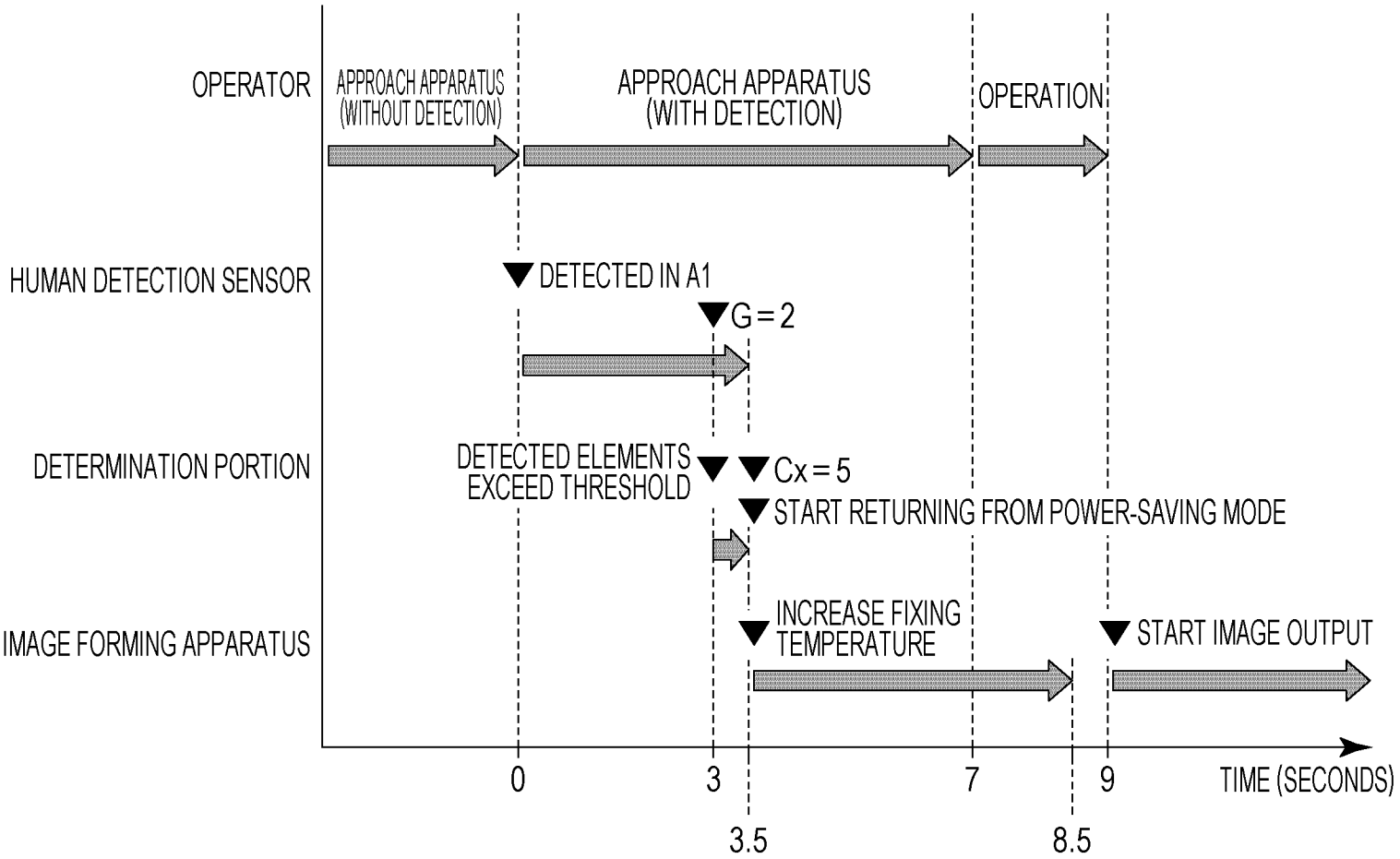
FIG. 11 is a schematic chart for describing operation in the low-temperature state in the first reference example.

Next, a difference in a time until the image forming apparatus 100 returns to an image formable state after switching from the power-saving mode to the normal mode between the case of performing the control of the present reference example and the case (a comparative example) of not performing the control will be described. FIGS. 9 to 11 are schematic charts of a temporal relationship in operation among the portions when the image forming apparatus 100 returns from the power-saving mode. Note that the horizontal axis of FIGS. 9 to 11 indicates the time. As described with reference to FIG. 8, T=0 second is the point of time at which the human detection sensor 61 first detects a temperature difference of equal to or higher than 1° C. from the background temperature.

FIG. 9 illustrates operation in a case (a high-temperature state) where the temperature of the fixing film 46*a* in the power-saving mode is 15° C. The specified value G is set to "6." Note that operation illustrated in FIG. 9 corresponds to operation of the present reference example in a case (the high-temperature state) where the temperature of the fixing film 46*a* in the power-saving mode is equal to or higher than 10° C. Before a time point T of 0 second, the operator is not detected by the human detection sensor 61. When the operator approaches the image forming apparatus 100, the human detection sensor 61 starts detecting the operator (the time point T=0 second). Thereafter, when the number of elements having detected a temperature difference of equal to or higher than 1° C. from the background temperature in the second detection area A2 of the human detection sensor 61 reaches a specified value G of 6 (the time point T=5 seconds), the determination portion 62 determines whether or not switching from the power-saving mode to the normal mode is to be performed. In this example, a case where the operator approaches the image forming apparatus 100 is assumed, and therefore, a temperature difference of equal to or higher than 1° C. from the background temperature is continuously detected by the elements equal to or greater than a specified value G of 6 in the second detection area A2. Then, at a time point T of 5.5 seconds, i.e., a time point at which the above-described count value C (FIG. 6) reaches a specified count value Cx of 5, switching from the power-saving mode to the normal mode is performed, and the image forming apparatus 100 starts returning to the image formable state. Energization to the fixing device 46 begins at a time point T of 5.5 seconds, but the temperature of the fixing film 46*a* increases to such a temperature that the fixing device 46 is usable within about three seconds as described above in a case where the temperature of the fixing film 46*a* in the power-saving mode is equal to or higher than 15° C. Thus, preparation for image formation by the image forming apparatus 100 is completed at a time point T of 8.5 seconds, and the image forming apparatus 100 is brought into the image formable state. Meanwhile, the operator reaches such a position ((f) of FIG. 8) that the image forming apparatus 100 is operable until a time point T of 7 seconds, and operates the operation portion 5 for about two seconds to instruct the image forming apparatus 100 to start image formation (the time point T=9 seconds). As described above, in a case where the temperature of the fixing film 46*a* in the power-saving mode is 15° C., preparation for image formation is completed until the operator completes operation, and therefore, image formation can be performed without keeping the operator waiting.

FIG. 10 illustrates operation in a case (a comparative example) where the temperature of the fixing film 46*a* in the power-saving mode is 5° C. (a low-temperature state) and the specified value G is constantly set to "6" regardless of the temperature. Movement of the operator, detection by the human detection sensor 61, and determination conditions of the determination portion 62 in this case are the same as those of the case of FIG. 9. Energization to the fixing device 46 begins at a time point T of 5.5 seconds, but the temperature of the fixing film 46*a* increases to such a temperature that the fixing device 46 is usable within about five seconds as described above in a case where the temperature of the fixing film 46*a* in the power-saving mode is 5° C. Thus, preparation for image formation by the image forming apparatus 100 is completed at a time point T of 10.5 seconds. Meanwhile, the operator reaches such a position ((f) of FIG. 8) that the image forming apparatus 100 is operable until a time point T of 7 seconds, and operates the operation portion 5 for about two seconds to instruct the image forming apparatus 100 to start image formation (the time point T=9 seconds). As described above, in the comparative example, preparation for image formation is not completed yet even when the operator completes operation, leading to such a waiting time that the operator needs to wait for the start of image formation.

FIG. 11 illustrates operation in a case (the present reference example) where the temperature of the fixing film 46*a* in the power-saving mode is 5° C. (the low-temperature state) and the specified value G is changed according to the temperature. The temperature of the fixing film 46*a* in the power-saving mode is lower than 10° C., and therefore, the specified value G is set to "2" as described above. Before a time point T of 0 second, the operator is not detected by the human detection sensor 61. When the operator approaches the image forming apparatus 100, the human detection sensor 61 starts detecting the operator (the time point T=0 second). Thereafter, when the number of elements having detected a temperature difference of equal to or higher than 1° C. from the background temperature in the second detection area A2 of the human detection sensor 61 reaches a specified value G of 2 (the time point T=3 seconds), the determination portion 62 determines whether or not switching from the power-saving mode to the normal mode is to be performed. In this example, a case where the operator approaches the image forming apparatus 100 is assumed, and therefore, a temperature difference of equal to or higher than 1° C. from the background temperature is continuously detected by the elements equal to or greater than a specified value G of 2 in the second detection area A2. Then, at a time point T of 3.5 seconds, i.e., a time point at which the count value C reaches a specified count value Cx of 5, switching from the power-saving mode to the normal mode is performed, and the image forming apparatus 100 starts returning to the image formable state. Energization to the fixing device 46 begins at a time point T of 3.5 seconds, but the temperature of the fixing film 46*a* increases to such a temperature that the fixing device 46 is usable within about five seconds as described above in a case where the temperature of the fixing film 46*a* in the power-saving mode is 5° C. Thus, preparation for image formation by the image forming apparatus 100 is completed at a time point T of 8.5 seconds. Meanwhile, the operator reaches such a position ((f) of FIG. 8) that the image forming apparatus 100 is operable until a time point T of 7 seconds, and operates the operation portion 5 for about two seconds to instruct the image forming apparatus 100 to start image formation (the time point T=9 seconds). As described above, preparation for image formation is completed until the operator completes operation in the present reference example, and therefore, image formation can be performed without keeping the operator waiting.

As described above, in the present reference example, in a case where the time until the temperature of the fixing device 46 increases to the usable temperature in the low-temperature environment is long, the response sensitivity in switching from the power-saving mode to the normal mode according to the detection result of the human detection sensor 61 is increased. With this configuration, the image forming apparatus 100 starts returning to the image formable state earlier in the low-temperature environment than in the high-temperature environment, and therefore, the waiting time until image formation is available after the operator has reached the image forming apparatus 100 can be reduced. Preferably, such a waiting time can be eliminated.

First Embodiment

Next, an embodiment of the present invention will be described. Basic configuration and operation of an image forming apparatus of the present embodiment are the same as those of the image forming apparatus of the first reference example. Thus, in the image forming apparatus of the present embodiment, the same numerals as those of the first reference example are used to represent elements having identical or corresponding functions or configurations to those of the image forming apparatus of the first reference example, and detailed description thereof will not be repeated.

1. Outline of First Embodiment

In the first reference example, in a case where the time until the temperature of a fixing device 46 increases to the usable temperature in the low-temperature environment is long, the response sensitivity in switching from the power-saving mode to the normal mode according to the detection result of the human detection sensor 61 is increased. On the other hand, in the first embodiment, in a case where a time until driving of a polygon motor 43*c* of an exposure device 43 is stabilized in low-temperature environment is long, response sensitivity in power supply according to a detection result of a human detection sensor 61 is increased.

Note that in the first embodiment, a temperature sensor 7 is arranged in the vicinity of the exposure device 43 of a printer portion 4 (the temperature sensor 7 may be arranged in the exposure device 43), thereby detecting the temperature of ambient atmosphere of the exposure device 43.

2. Problems in Low-Temperature State (Driving of Polygon Motor)

A polygon mirror 43*b* of the exposure device 43 is connected to the polygon motor 43*c* configured to rotate the polygon mirror 43*b*. Normally, the polygon mirror 43*b* is stopped when an image forming apparatus 100 does not perform image formation. In a case where the image forming apparatus 100 receives a print signal, rotation of the polygon mirror 43*b* begins, and image formation is performed when a rotation period reaches a period necessary for image formation. As described above, the exposure device 43 is at least one of power supply targets of a power source portion 1.

Considering stabilization of driving of the polygon motor 43*c* and reduction of noise, oil is generally applied to a bearing of the polygon motor 43*c*. However, such oil generally has such characteristics that viscosity is exhibited in low-temperature environment. Thus, in the low-temperature environment, tendency shows that a time until driving is stabilized (i.e., until the rotation period of the polygon motor 43*c* reaches the rotation period necessary for image formation) after rotary driving of the polygon motor 43*c* has begun is long.

For this reason, in the present embodiment, in a case where the temperature of the ambient atmosphere of the exposure device 43 detected by the temperature sensor 7 is lower than a predetermined value, the response sensitivity in power supply according to the detection result of the human detection sensor 61 is increased. More specifically, in the present embodiment, a main controller portion 2 more decreases a specified value G in a case where the temperature of the ambient atmosphere of the exposure device 43 is lower than 10° C. than in a case where such a temperature is equal to or higher than 10° C. In the present embodiment, the specified value G is, as in the first reference example, set to "6" in a case where the temperature detected by the temperature sensor 7 is equal to or higher than 10° C., and is set to "2" in a case where such a temperature is lower than 10° C.

3. Control Procedure

The procedure of sensitivity changing processing performed by the main controller portion 2 in the present embodiment is similar to that described with reference to FIG. 5 in the first reference example. Note that in the present embodiment, the main controller portion 2 acquires the temperature X of ambient atmosphere of the exposure device 43 detected by the temperature sensor 7 in the processing corresponding to the processing of S101 of FIG. 5.

Moreover, the procedure of power supply determination processing performed by a determination portion 62 in the present embodiment is the same as that described with reference to FIG. 6 in the first reference example.

4. Operation Example

Figure 12:
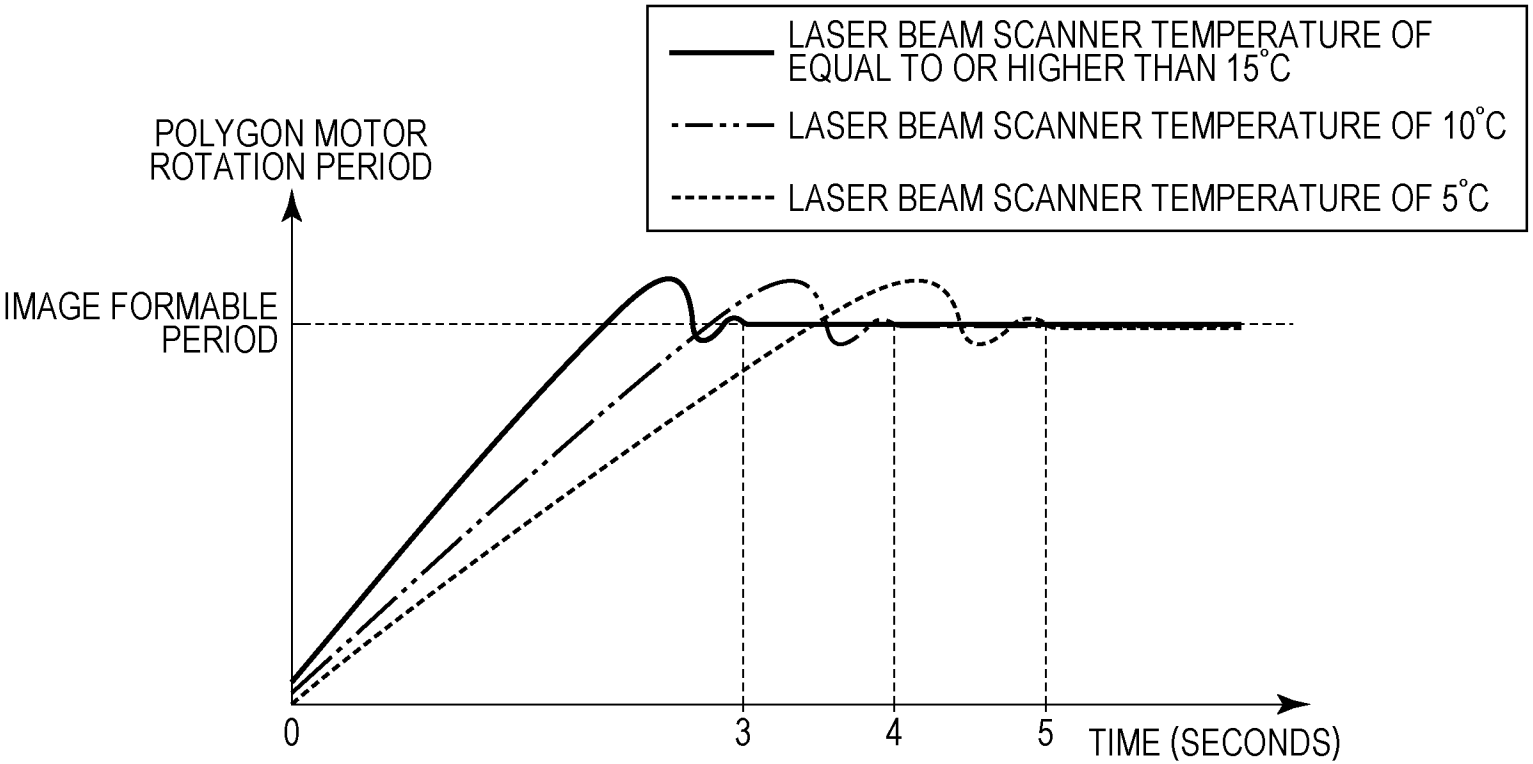
FIG. 12 is a graph for describing a start-up time of an exposure device.

FIG. 12 is a graph of a time until driving of the polygon motor 43*c* is stabilized after power supply to the printer portion 4 including the exposure device 43 has begun. Note that in this embodiment, stabilization of driving of the polygon motor 43*c* means stabilization of the rotation period of the polygon motor 43*c* at an image formable period after the polygon motor 43*c* has started rotating. In FIG. 12, the horizontal axis indicates the time after the start of power supply to the exposure device 43, and the vertical axis indicates the rotation period of the polygon motor 43*c*.

In a case where the temperature of ambient atmosphere of the exposure device 43 is equal to or higher than 15° C., driving of the polygon motor 43*c* is stabilized after a lapse of about three seconds from the start of power supply to the exposure device 43. On the other hand, in a case where the temperature of ambient atmosphere of the exposure device 43 is 10° C., driving of the polygon motor 43*c* is stabilized after a lapse of about four seconds from the start of power supply to the exposure device 43. Moreover, in a case where the temperature of ambient atmosphere of the exposure device 43 is 5° C., driving of the polygon motor 43*c* is stabilized after a lapse of about five seconds from the start of power supply to the exposure device 43. That is, in a case where the temperature of ambient atmosphere of the exposure device 43 is relatively low, it takes a relatively-long time until driving of the polygon motor 43*c* is stabilized. Note that in a case where the temperature of ambient atmosphere of the exposure device 43 is lower than 5° C., tendency shows that it takes more time to stabilize driving of the polygon motor 43*c*. Note that in the present embodiment, in environment where the temperature of ambient atmosphere of the exposure device 43 is lower than 5° C., operation of the image forming apparatus 100 might be slower due to another cause such as out of warranty of hard drive operation of the main controller portion 2. Thus, description will be made herein, focusing on environment with a temperature of equal to or higher than 5° C.

In the present embodiment, a relationship between a situation where an operator approaches the image forming apparatus 100 and the element(s) of the human detection sensor 61 detecting a heat source in such a situation is the same as that described with reference to FIG. 8 in the first reference example.

Figure 13:
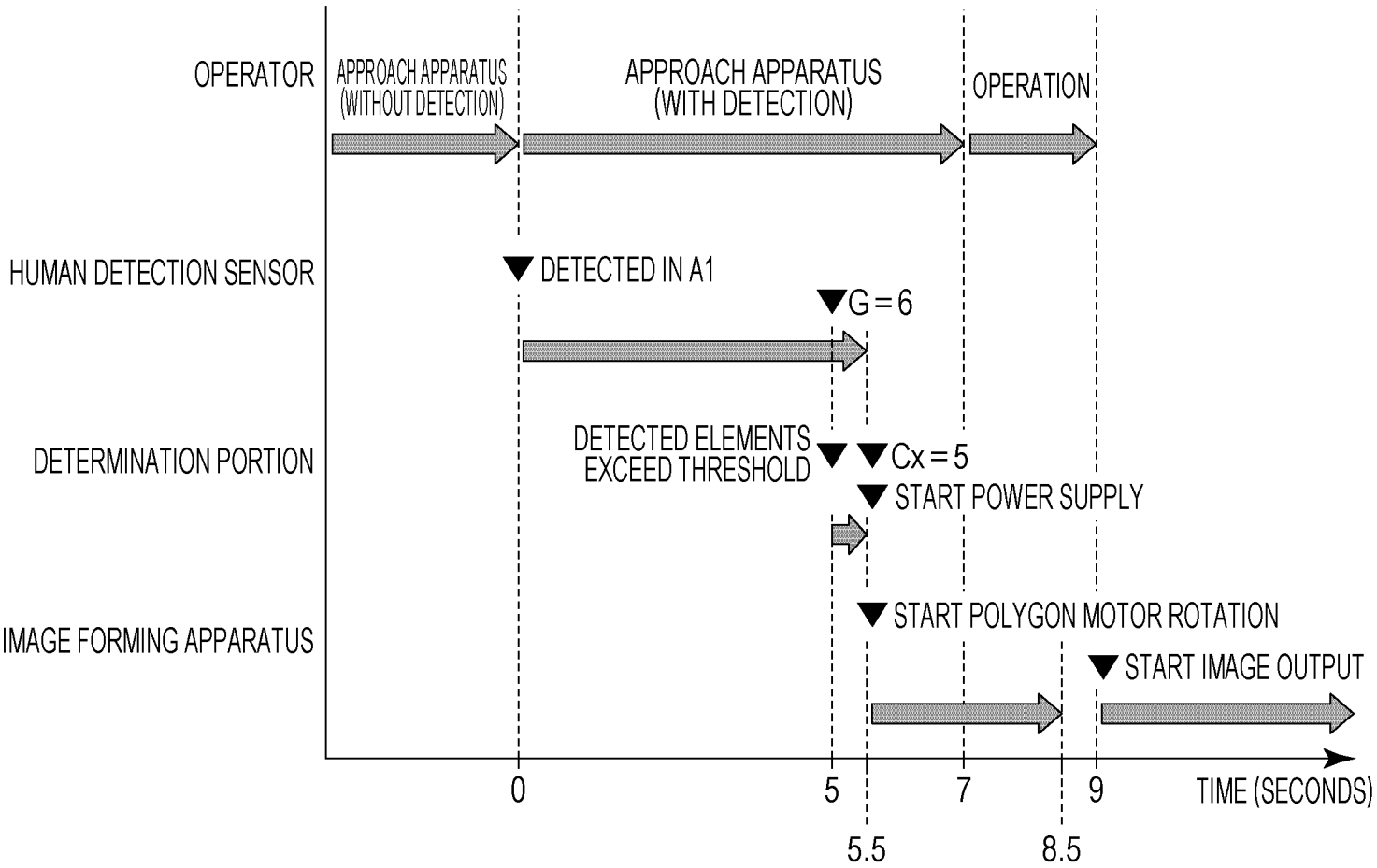
FIG. 13 is a schematic chart for describing operation in the high-temperature state in a first embodiment.
Figure 14:
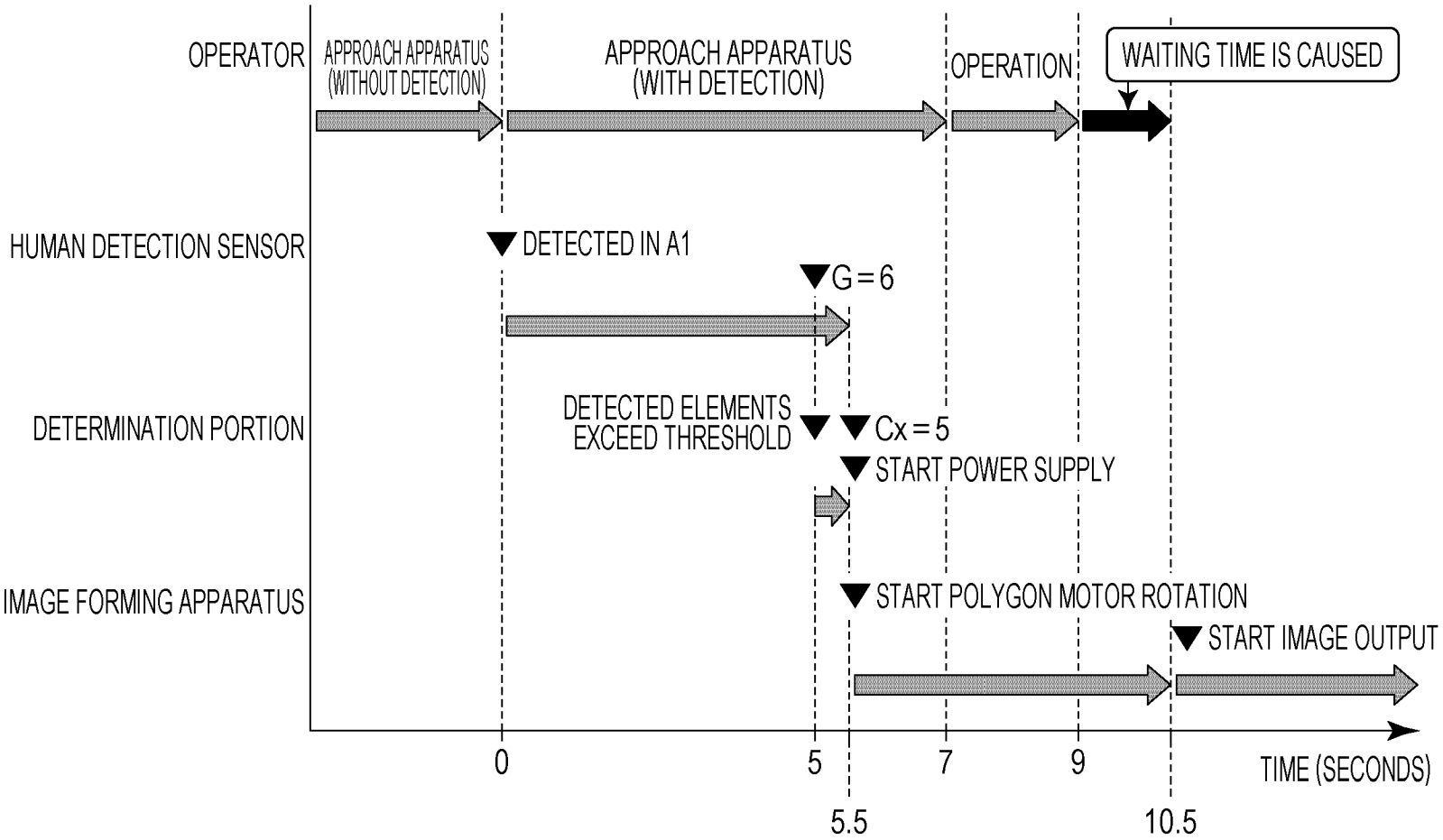
FIG. 14 is a schematic chart for describing operation in the low-temperature state in a comparative example.
Figure 15:
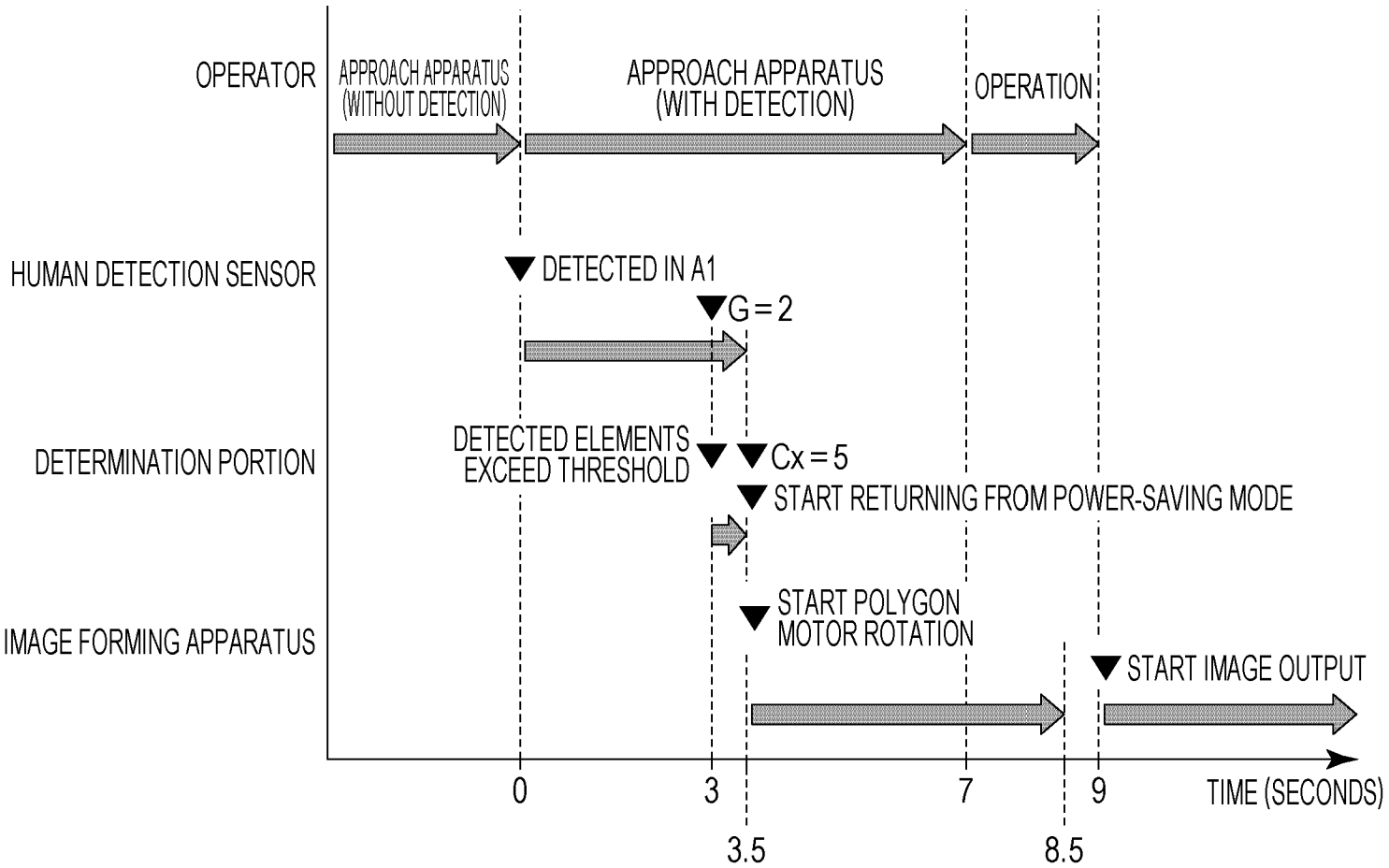
FIG. 15 is a schematic chart for describing operation in the low-temperature state in the first reference example.

FIGS. 13 to 15 are schematic charts of a temporal relationship in operation among the portions when the image forming apparatus 100 returns from a power-saving mode. FIG. 13 illustrates operation (corresponding to operation of the present embodiment in a case where the temperature of ambient atmosphere of the exposure device 43 is equal to or higher than 10° C.) in a case (a high-temperature state) where the temperature of ambient atmosphere of the exposure device 43 is 15° C. FIG. 14 illustrates operation in a case (a comparative example) where the temperature of ambient atmosphere of the exposure device 43 is 5° C. (a low-temperature state) and the specified value G is constantly set to "6" regardless of the temperature. FIG. 15 illustrates operation in a case (the present embodiment) where the temperature of ambient atmosphere of the exposure device 43 is 5° C. (the low-temperature state) and the specified value G is changed according to the temperature. In the present embodiment, times until driving of the polygon motor 43*c* is stabilized after the start of power supply to the exposure device 43 in a case where the temperature of ambient atmosphere of the exposure device 43 is 15° C. and 5° C. are each three seconds and five seconds. These values are the same as the times until the temperature of the fixing film 46*a* increases to such a temperature that the fixing device 46 is usable after the start of power supply to the fixing device 46 in a case where the temperature of the fixing film 46*a* in the first reference example is 15° C. and 5° C. Thus, the temporal relationship in operation among the portions as illustrated in FIGS. 13 to 15 is similar to that described with reference to FIGS. 9 to 11 in the first reference example. Note that the timing ("INCREASE FIXING TEMPERATURE" in the figures) of starting power supply to the fixing device 46 in FIGS. 9 to 11 is the timing ("START POLYGON MOTOR ROTATION" in the figures) of starting power supply to the exposure device 43 in FIGS. 13 to 15. In the present embodiment, preparation for image formation is, even in the low-temperature state, also completed until the operator completes operation as illustrated in FIG. 15, and therefore, image formation can be performed without keeping the operator waiting.

As described above, in the present embodiment, in a case where the time until driving of the polygon motor 43*c* of the exposure device 43 is stabilized in the low-temperature environment is long, the response sensitivity in power supply according to the detection result of the human detection sensor 61 is increased. With this configuration, the image forming apparatus 100 starts start-up to an image formable state earlier in the low-temperature environment than in high-temperature environment, and therefore, a waiting time until image formation is available after the operator has reached the image forming apparatus 100 can be reduced. Preferably, such a waiting time can be eliminated.

Second Reference Example

Next, another reference example of the present invention will be described. Basic configuration and operation of an image forming apparatus of the present reference example are the same as those of the image forming apparatus of the first reference example. Thus, in the image forming apparatus of the present reference example, the same numerals as those of the first reference example are used to represent elements having identical or corresponding functions or configurations to those of the image forming apparatus of the first reference example, and detailed description thereof will not be repeated.

1. Outline of Present Reference Example

In the first reference example, the infrared array sensor is used as the human detection sensor 61. On the other hand, in the present reference example, a reflection sensor is used as a human detection sensor 61.

2. Configuration of Human Detection Sensor (Reflection Sensor)

Figure 16A:
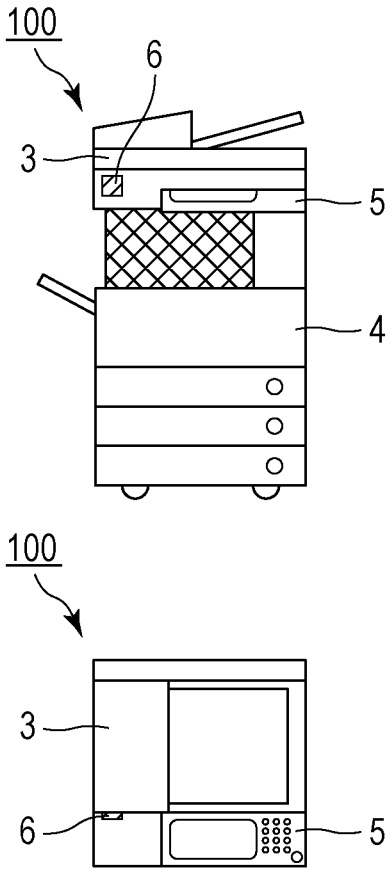
FIGS. 16A and 16B are schematic views for describing a detection area of another example of the human detection sensor.
Figure 16B:
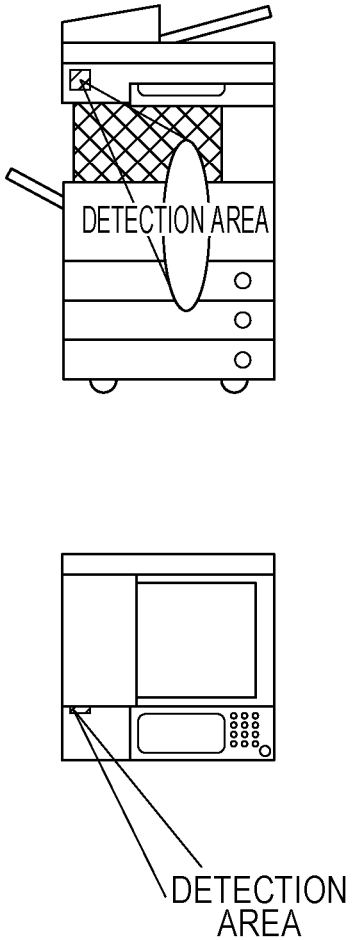

FIGS. 16A and 16B are schematic views for describing a detection area of the human detection sensor 61 in the present reference example. A schematic view of an outer appearance of an image forming apparatus 100 from the front side is on an upper side of FIG. 16A, and a schematic view of the outer appearance of the image forming apparatus 100 from above is on a lower side of FIG. 16A. Moreover, views on upper and lower sides of FIG. 16B are each similar to those on the upper and lower sides of FIG. 16A illustrated together with the detection area of the human detection sensor 61.

The image forming apparatus 100 of the present reference example has the reflection sensor as the human detection sensor 61. The reflection sensor 61 has a projection portion configured to emit infrared light, and a light receiving portion configured to receive the infrared light to output a detection voltage according to received light intensity. The reflection sensor 61 outputs the infrared light to receive the infrared light contacting and reflected from an object. Thus, a distance to the object can be, by means of the reflection sensor 61, estimated according to the received light intensity of the infrared light reflected from the object. In the present reference example, the detection area of the reflection sensor 61 is set to a forward direction from a main body 110 of the image forming apparatus 100 or an obliquely-downward direction with respect to the forward direction and the horizontal direction. With this configuration, the detection area of the reflection sensor 61 is set so that the infrared light reflected mainly from the body of an operator (a human body) approaching the image forming apparatus 100 to operate the image forming apparatus 100 (specifically an operation portion 5 in the present reference example) can be detected.

Figure 17A:
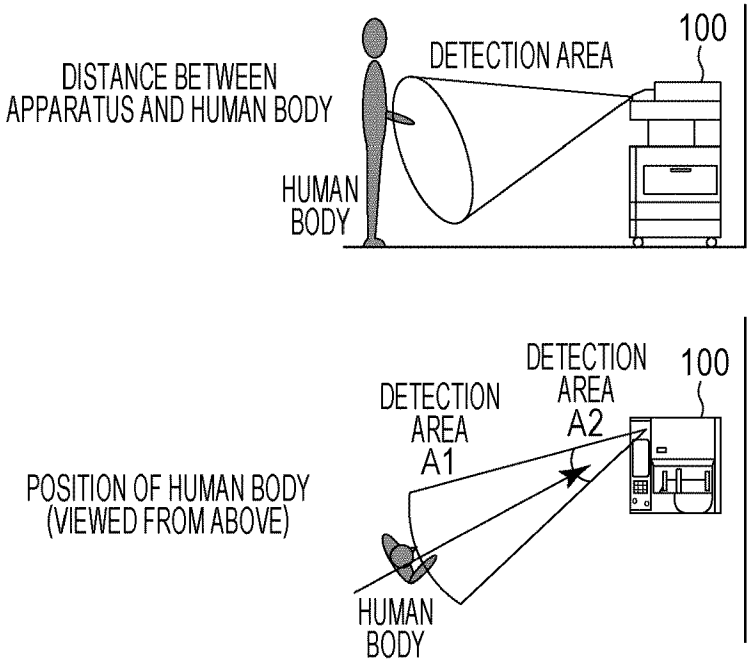
FIGS. 17A to 17C are schematic views for describing a detection result of another example of the human detection sensor.
Figure 17B:
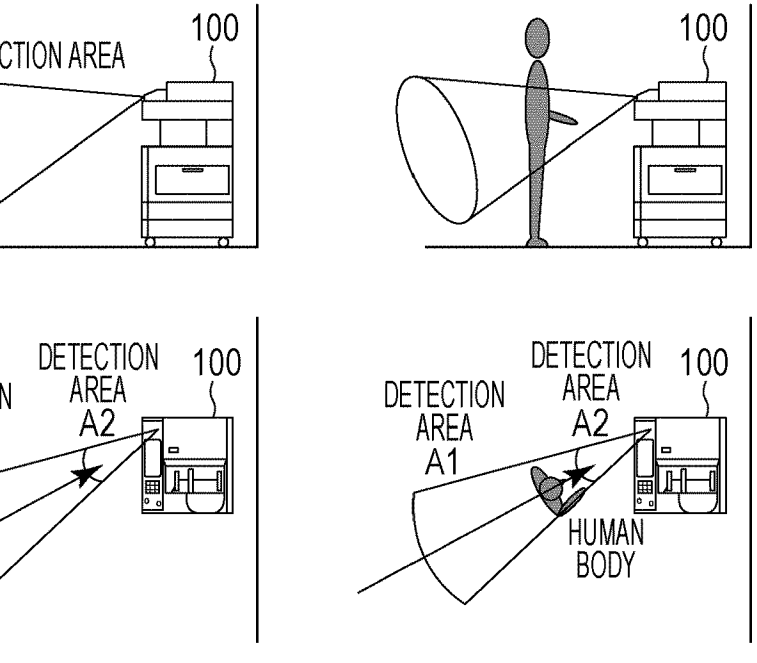
Figure 17C:
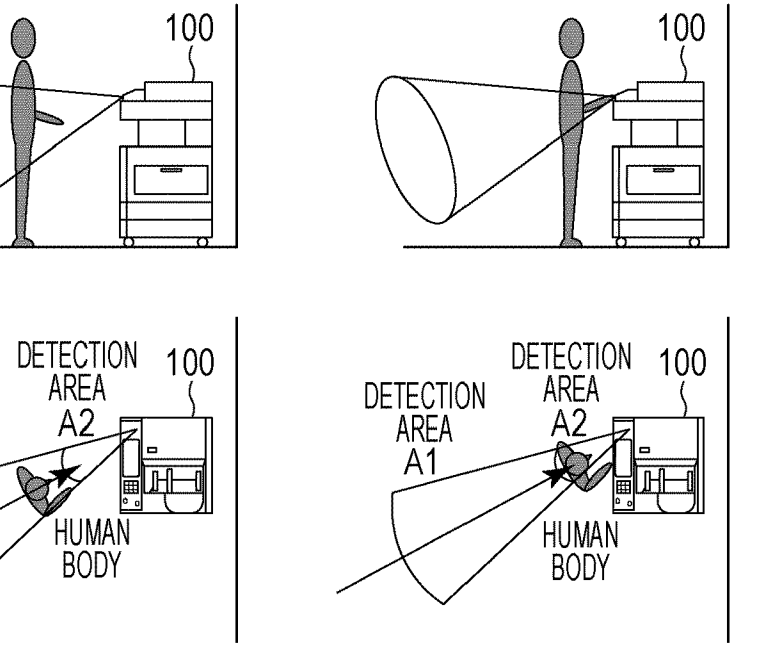

FIGS. 17A to 17C are schematic views for describing a detection result of the reflection sensor 61 according to a distance between the image forming apparatus 100 and the human body. A positional relationship between the image forming apparatus 100 and the human body as viewed from the right side is illustrated on an upper side of each of FIGS. 17A to 17C. Moreover, a positional relationship between the image forming apparatus 100 and the human body as viewed from above is illustrated on the middle of each of FIGS. 17A to 17C. Further, the detection result of the reflection sensor 61 in the positional relationships between the image forming apparatus 100 and the human body as illustrated on the upper side and the middle is illustrated on a lower side of each of FIGS. 17A to 17C.

FIG. 17A illustrates the positional relationship between the image forming apparatus 100 and the human body and the detection result of the reflection sensor 61 right after the human body has entered the detection area of the reflection sensor 61. In the state of FIG. 17A, the reflection sensor 61 starts outputting the detection voltage. In the present reference example, a determination portion 62 determines that a person is present in a first detection area A1 in a case where a detection voltage (note that equal to or higher than 0.5 V) lower than a specified value Vth of a detection voltage corresponding to a case where the distance between the image forming apparatus 100 and the human body is a predetermined distance is output from the reflection sensor 61. Moreover, the determination portion 62 determines that the person is present in a second detection area A2 in a case where a detection voltage of equal to or higher than the specified value Vth is output from the reflection sensor 61. Note that as in the first reference example, the first detection area A1 is a detection area where switching from a power-saving mode to a normal mode is not performed even when the person is present, and the second detection area A2 is a detection area where switching from the power-saving mode to the normal mode is performed in a case where a predetermined condition is satisfied when the person is present. FIG. 17B illustrates the positional relationship between the image forming apparatus 100 and the human body and the detection result of the reflection sensor 61 in a case where the human body more approaches the image forming apparatus 100 as compared to the state of FIG. 17A. In the state of FIG. 17B, the detection voltage output from the reflection sensor 61 is higher than that in the state of FIG. 17A. However, such a detection voltage does not exceed the specified value Vth, and therefore, a power supply mode is maintained at the power-saving mode. FIG. 17C illustrates the positional relationship between the image forming apparatus 100 and the human body and the detection result of the reflection sensor 61 in a case where the human body much more approaches the image forming apparatus 100 as compared to the state of FIG. 17B and reaches such a position that the human body (the operator) can operate the image forming apparatus 100. In the state of FIG. 17C, the detection voltage output from the reflection sensor 61 exceeds the specified value Vth. In the present reference example, it is determined, based on the detection voltage of the reflection sensor 61 equal to or higher than the specified value Vth (the distance between the image forming apparatus 100 and the human body) and a continuous detection voltage output time (a dwell time), whether or not switching from the power-saving mode to the normal mode is to be performed.

As described above, in the present reference example, the reflection sensor 61 as a movable body sensor outputs a signal changeable in a predetermined direction (a value increasing direction in the present reference example) as one of the value increasing direction or a value decreasing direction when a movable body approaches the image forming apparatus 100. Specifically, in the present reference example, the human detection sensor 61 is the reflection sensor configured to detect light reflection from the movable body. Moreover, in the present reference example, the determination portion 62 causes a main controller portion 2 to switch the power supply mode in a case where the value of the signal output from the human detection sensor 61 exceeds a predetermined value as a threshold in the above-described predetermined direction. Further, as will be described later in detail, the main controller portion 2 changes, in the present reference example, the above-described predetermined value as follows according to a temperature detected by a temperature sensor 7. That is, the main controller portion 2 does not change the above-described predetermined value in the case of a first temperature, but changes the above-described predetermined value in the case of a second temperature lower than the first temperature to a value (a smaller value in the present reference example) corresponding to a case where the distance between the image forming apparatus 100 and the movable body is long.

3. Problems in Low-Temperature State (Fixing Temperature Adjustment)

In the present reference example, a time until the temperature of a fixing device 46 increases to a usable temperature in low-temperature environment might be long as in the first reference example.

For this reason, in the present reference example, in a case where the temperature of a fixing film 46*a* detected by the temperature sensor 7 is lower than a predetermined value, response sensitivity in switching from the power-saving mode to the normal mode according to the detection result of the human detection sensor 61 is increased as in the first reference example. In the present reference example, the main controller portion 2 as a sensitivity changing portion executes such processing. Specifically, in the present reference example, the main controller portion 2 changes the specified value Vth of the detection voltage of the human detection sensor 61, the specified value Vth being used for determination by the determination portion 62 on whether or not switching from the power-saving mode to the normal mode is to be performed. More specifically, in the present reference example, in a case where the temperature of the fixing film 46*a* detected by the temperature sensor 7 is lower than 10° C., the main controller portion 2 more decreases the specified value Vth as compared to that in a case where such a temperature is equal to or higher than 10° C. In the present reference example, the range of the detection voltage of the human detection sensor 61 is 0 to 5 V. Moreover, in the present reference example, the specified value Vth is set to "3 V" in a case where the temperature detected by the temperature sensor 7 is equal to or higher than 10° C., and is set to "2 V" in a case where such a temperature is lower than 10° C.

4. Control Procedure

Figure 18:
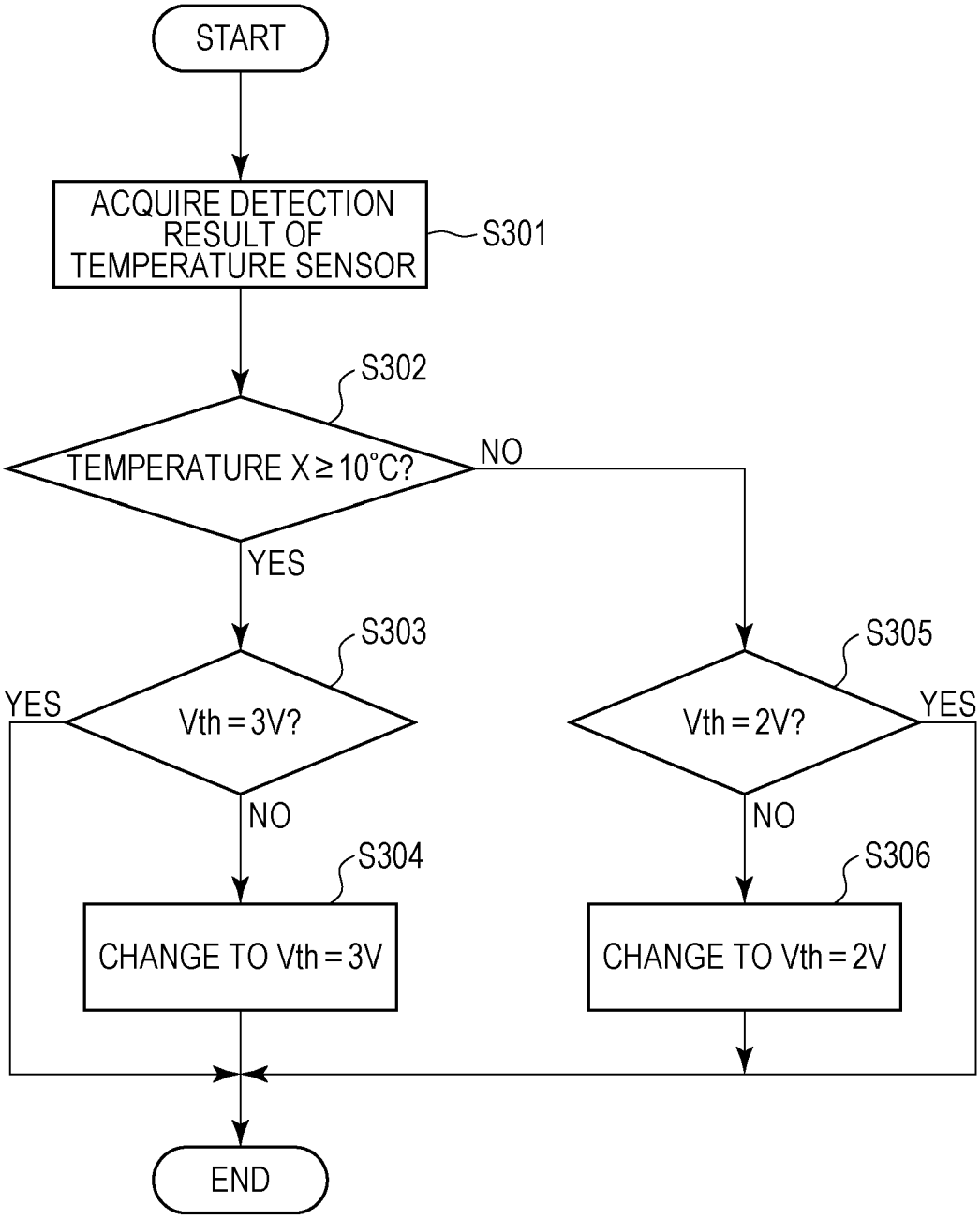
FIG. 18 is a flowchart of another example of the sensitivity changing processing.

Next, sensitivity changing processing performed by the main controller portion 2 will be described. FIG. 18 is a flowchart of the outline of the procedure of the sensitivity changing processing in the present reference example. This sensitivity changing processing may be regularly executed in the power-saving mode, or may be executed right before execution of the processing of S402 in the later-described procedure of FIG. 19. The procedure of the sensitivity changing processing in the present reference example is substantially similar to that described with reference to FIG. 5 in the first reference example, but is changed in accordance with use of the reflection sensor as the human detection sensor 61 in the present reference example.

The main controller portion 2 acquires a temperature X detected by the temperature sensor 7 (S301), and determines whether or not the temperature X is equal to or higher than 10° C. (S302). In a case where the main controller portion 2 determines, at S302, that the temperature X is equal to or higher than 10° C., the main controller portion 2 determines whether or not the specified value Vth held in a storage portion of the determination portion 62 is "3 V" (S303). Then, in a case where the main controller portion 2 determines as not being "3 V" at S303, the main controller portion 2 changes the specified value Vth held in the storage portion of the determination portion 62 to "3 V" (S304). In a case where the main controller portion 2 determines as being "3 V" at S303, the processing ends. In a case where the main controller portion 2 determines, at S302, that the temperature X is not equal to or higher than 10° C. (lower than 10° C.), the main controller portion 2 determines whether or not the specified value Vth held in the storage portion of the determination portion 62 is "2 V" (S305). In a case where the main controller portion 2 determines as not being "2 V" at S305, the main controller portion 2 changes the specified value Vth held in the storage portion of the determination portion 62 to "2 V" (S306). In a case where the main controller portion 2 determines as being "2 V" at S305, the processing ends.

Figure 19:
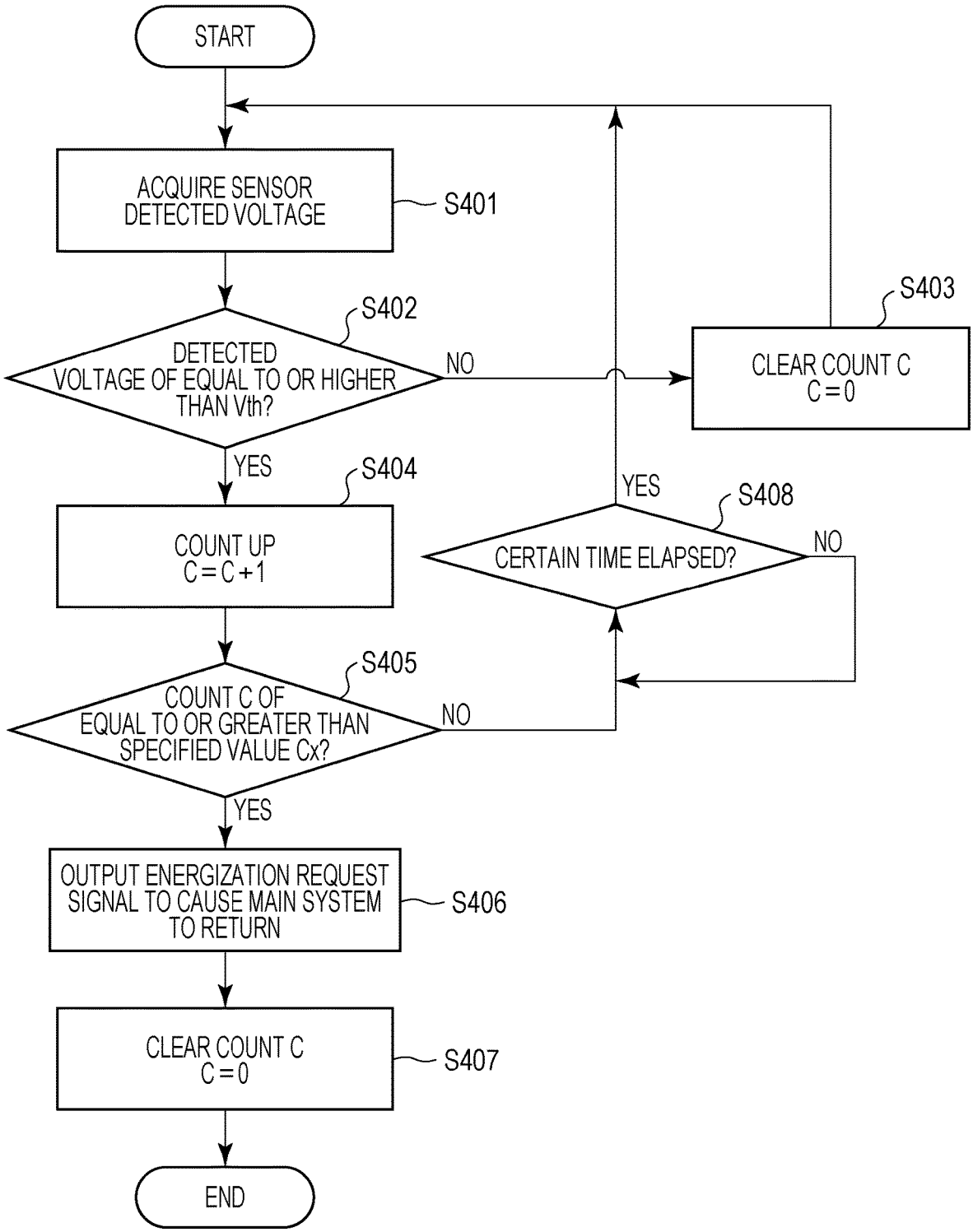
FIG. 19 is a flowchart of another example of the power supply determination processing.

Next, the processing of determining switching of the power supply mode by the determination portion 62 will be described. FIG. 19 is a flowchart of the outline of the procedure of the determination processing in the present reference example. This determination processing is substantially constantly executed in the power-saving mode. The procedure of the determination processing in the present reference example is substantially similar to that described with reference to FIG. 6 in the first reference example, but is changed in accordance with use of the reflection sensor as the human detection sensor 61 in the present reference example.

The determination portion 62 acquires the detection voltage output from the human detection sensor 61 (S401). Subsequently, the determination portion 62 determines whether or not the acquired detection voltage is equal to or greater than the specified value Vth (S402). As described above, in a case where the temperature X detected by the temperature sensor 7 is equal to or higher than 10° C., the specified value Vth is set to "3 V." In a case where the temperature X is lower than 10° C., the specified value Vth is set to "2 V."

The processing of S403 and S404 to S408 of FIG. 19 is similar to that of S205 and S207 to S211 of FIG. 6 as described in the first reference example. In this reference example, a certain time Y is 0.1 seconds as in the first reference example. In the present reference example, the certain time Y is an interval at which the human detection sensor 61 emits the infrared light. An optional value can be set as the value of the certain time Y according to, e.g., a desired response speed of the human detection sensor 61. Alternatively, the value of the certain time Y may be changed (selected) as necessary by the operator according to, e.g., the desired response speed of the human detection sensor 61. A shorter certain time Y results in a higher frequency of emission of the infrared light, and therefore, tendency shows that power consumption increases. However, the human body can be detected at a higher response speed.

Note that as in the first reference example, a temperature threshold and the specified value Vth for determination on the low-temperature environment are not limited to the values of the present reference examples. Optional values can be set as these values, or these values may be changed (selected) as necessary by the operator.

5. Operation Example

A relationship between a time after power supply to a printer portion 4 including the fixing device 46 has begun and the temperature of the fixing film 46*a* of the fixing device 46 in the present reference example is the same as that described with reference to FIG. 7 in the first reference example.

Figure 20:
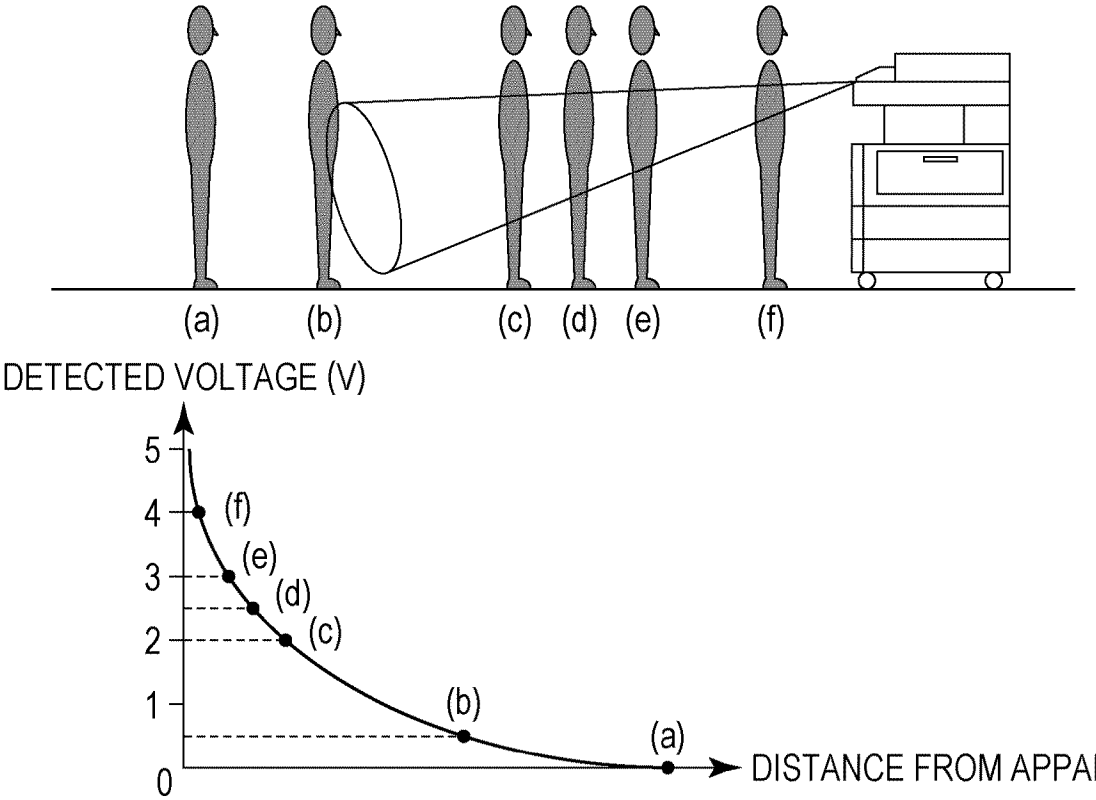
FIG. 20 is a schematic view of another example of the detection result of the human detection sensor.

FIG. 20 is a schematic view of a relationship between a situation where the operator moves to positions (a), (b), (c), (d), (e), (f) in this order to approach the image forming apparatus 100 and the detection voltage output from the human detection sensor 61 in such a situation.

In a case where the operator is at the position (a), almost no detection voltage (lower than 0.5 V) is output from the human detection sensor 61, and the power supply mode is not switched. When the operator moves to the position (b), the detection voltage output from the human detection sensor 61 reaches 0.5 V. For the sake of convenience, a time point at which the operator is at the position (b) is T=0 second. Thereafter, when the operator moves to each of the positions (c), (d), (e), the detection voltage output from the human detection sensor 61 increases to 2 V, 2.5 V, and 3V. Time points at which the operator is at the positions (c), (d), (e) are each T=3 seconds, 4 seconds, and 5 seconds. Then, when the operator moves to the position (f), the detection voltage output from the human detection sensor 61 reaches 4 V. A time point at which the operator is at the position (f) is T=7 seconds. The operator can operate the image forming apparatus 100 via an interface such as the operation portion 5 when approaching the image forming apparatus 100 to reach the position (f). In a case where the detection result of the human detection sensor 61 is taken as a trigger to perform switching from the power-saving mode to the normal mode, it is preferable that the operator can start image formation as soon as possible after having approached the image forming apparatus 100 to operate the image forming apparatus 100 at the position (f).

Figure 21:
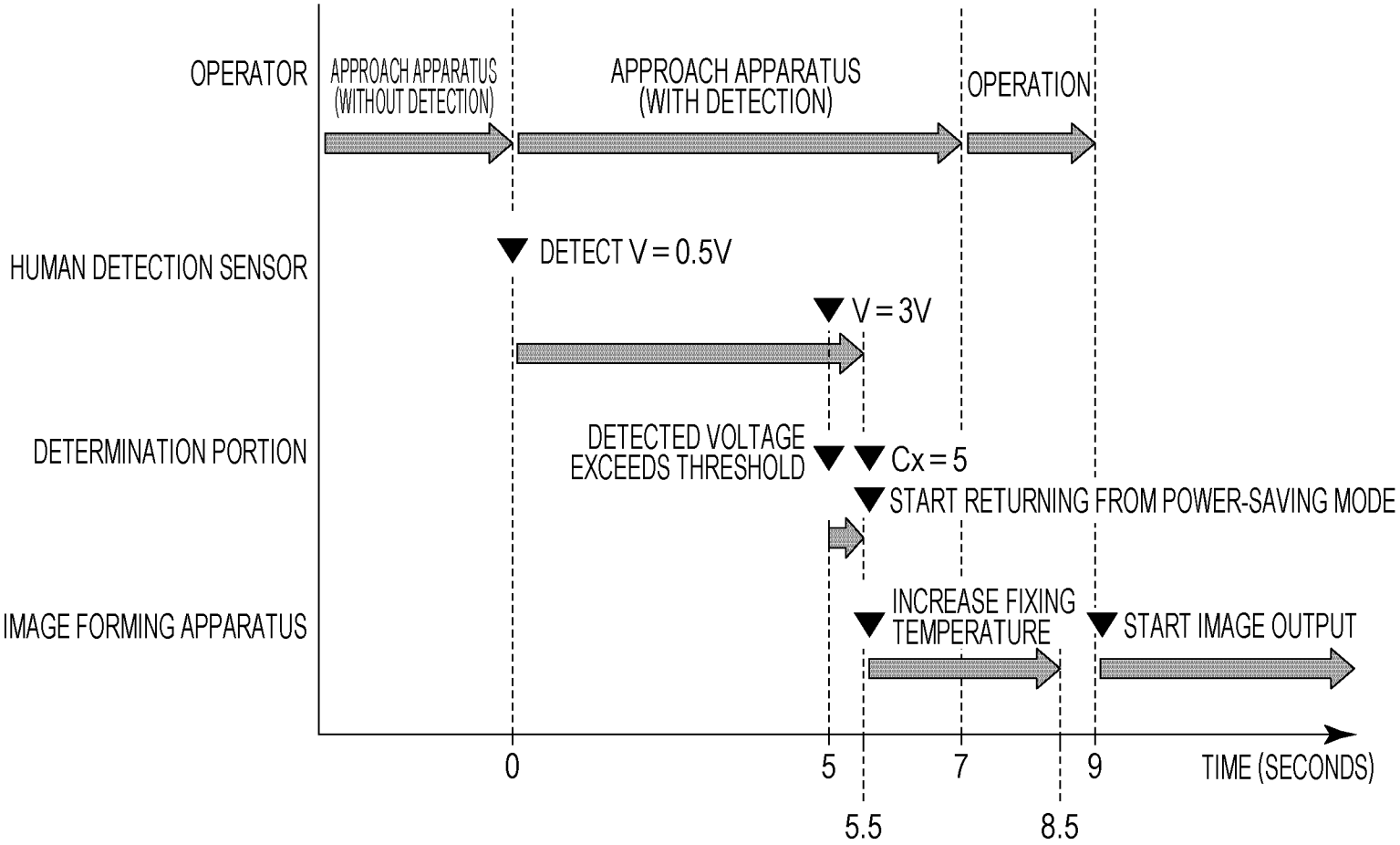
FIG. 21 is a schematic chart for describing operation in the high-temperature state in a second reference example.
Figure 22:
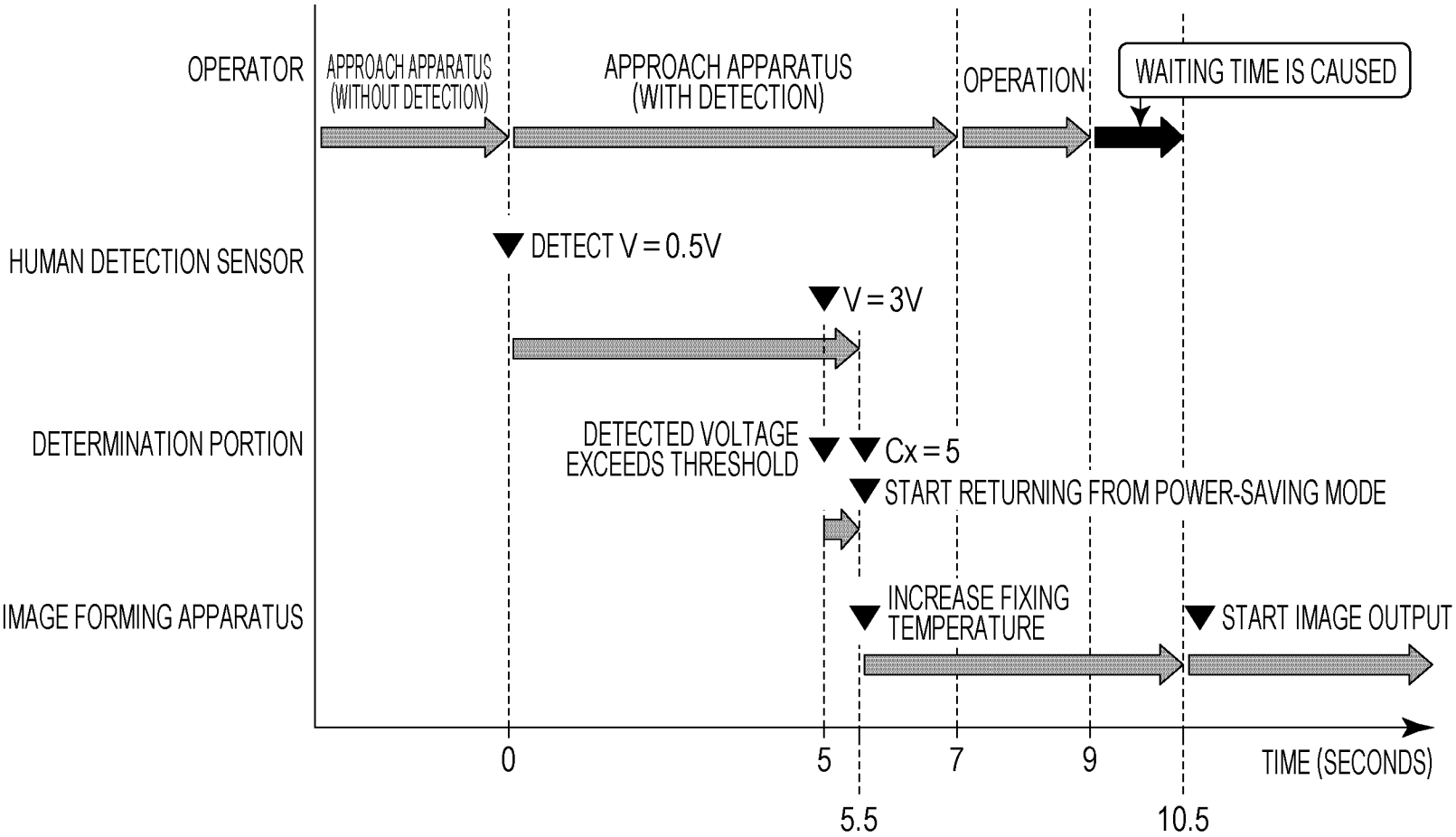
FIG. 22 is a schematic chart for describing operation in the low-temperature state in a comparative example.
Figure 23:
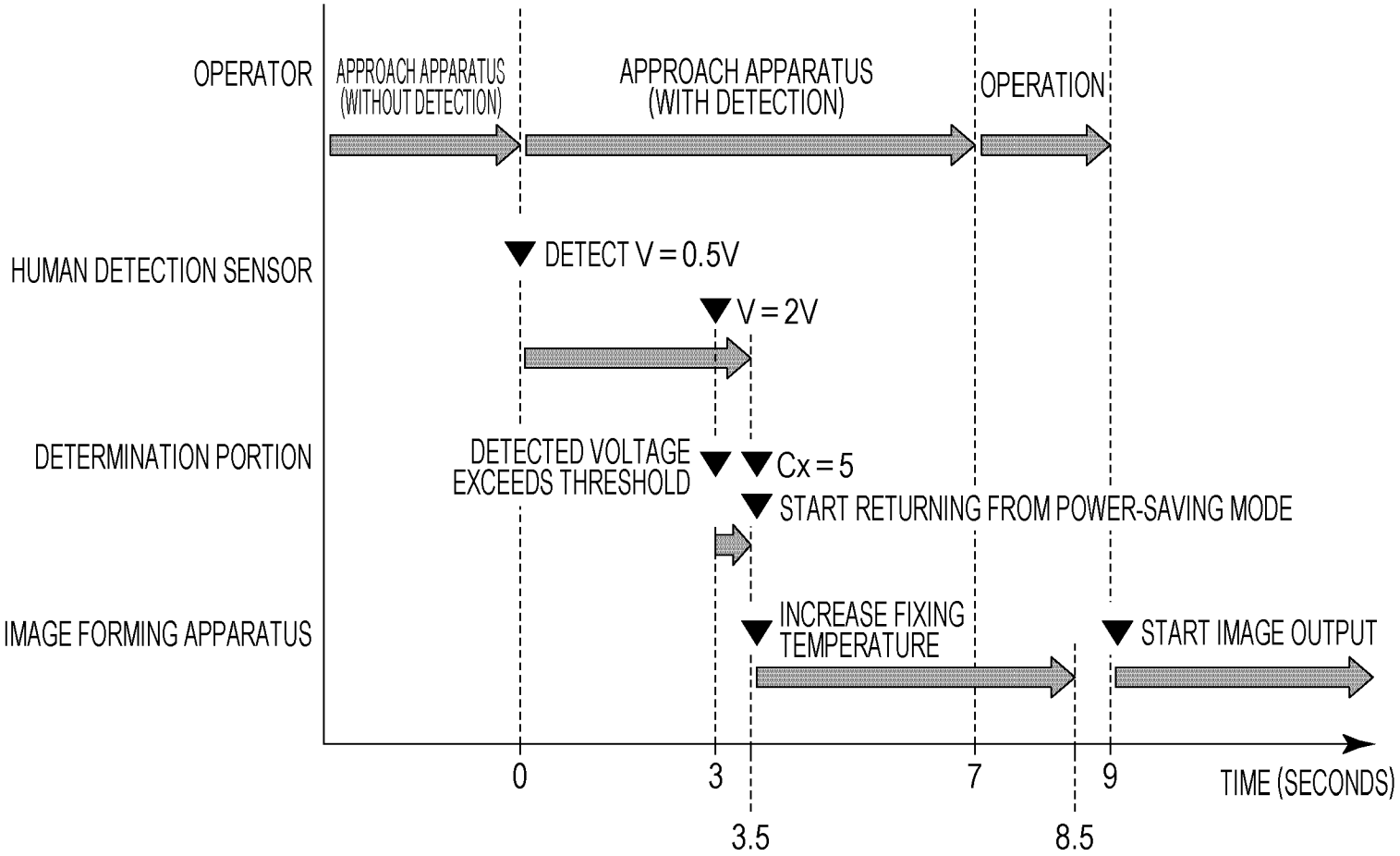
FIG. 23 is a schematic chart for describing operation in the low-temperature state in the second reference example.

Next, a difference in a time until the image forming apparatus 100 returns to an image formable state after switching from the power-saving mode to the normal mode between the case of performing the control of the present reference example and the case (a comparative example) of not performing the control will be described. FIGS. 21 to 23 are schematic charts of a temporal relationship in operation among the portions when the image forming apparatus 100 returns from the power-saving mode. Note that the horizontal axis of FIGS. 21 to 23 indicates the time. As described with reference to FIG. 20, T=0 second is the point of time at which the detection voltage output from the human detection sensor 61 first reaches 0.5 V.

FIG. 21 illustrates operation in a case (a high-temperature state) where the temperature of the fixing film 46*a* in the power-saving mode is 15° C. The specified value Vth is set to "3 V." Note that operation illustrated in FIG. 21 corresponds to operation of the present reference example in a case (the high-temperature state) where the temperature of the fixing film 46*a* in the power-saving mode is equal to or higher than 10° C. Before a time point T of 0 second, the operator is not detected by the human detection sensor 61. When the operator approaches the image forming apparatus 100, the detection voltage V output from the human detection sensor 61 reaches 0.5 V (the time point T=0 second). Thereafter, when the detection voltage V output from the human detection sensor 61 reaches a specified value Vth of 3 V (the time point T=5 seconds), the determination portion 62 determines whether or not switching from the power-saving mode to the normal mode is to be performed. In this example, a case where the operator approaches the image forming apparatus 100 is assumed, and therefore, a detection voltage V of equal to or higher than 3 V is continuously output. Then, at a time point T of 5.5 seconds, i.e., a time point at which a count value C (FIG. 19) reaches a specified count value Cx of 5, switching from the power-saving mode to the normal mode is performed, and the image forming apparatus 100 starts returning to the image formable state. Energization to the fixing device 46 begins at a time point T of 5.5 seconds, but the temperature of the fixing film 46*a* increases to such a temperature that the fixing device 46 is usable within about three seconds as described above in a case where the temperature of the fixing film 46*a* in the power-saving mode is equal to or higher than 15° C. Thus, preparation for image formation by the image forming apparatus 100 is completed at a time point T of 8.5 seconds, and the image forming apparatus 100 is brought into the image formable state. Meanwhile, the operator reaches such a position ((f) of FIG. 20) that the image forming apparatus 100 is operable until a time point T of 7 seconds, and operates the operation portion 5 for about two seconds to instruct the image forming apparatus 100 to start image formation (the time point T=9 seconds). As described above, in a case where the temperature of the fixing film 46*a* in the power-saving mode is 15° C., preparation for image formation is completed until the operator completes operation, and therefore, image formation can be performed without keeping the operator waiting.

FIG. 22 illustrates operation in a case (a comparative example) where the temperature of the fixing film 46*a* in the power-saving mode is 5° C. (a low-temperature state) and the specified value Vth is constantly set to "3 V" regardless of the temperature. Movement of the operator, detection by the human detection sensor 61, and determination conditions of the determination portion 62 in this case are the same as those of the case of FIG. 21. Then, energization to the fixing device 46 begins at a time point T of 5.5 seconds, but the temperature of the fixing film 46*a* increases to such a temperature that the fixing device 46 is usable within about five seconds as described above in a case where the temperature of the fixing film 46*a* in the power-saving mode is 5° C. Thus, preparation for image formation by the image forming apparatus 100 is completed at a time point T of 10.5 seconds. Meanwhile, the operator reaches such a position ((f) of FIG. 20) that the image forming apparatus 100 is operable until a time point T of 7 seconds, and operates the operation portion 5 for about two seconds to instruct the image forming apparatus 100 to start image formation (the time point T=9 seconds). As described above, in the comparative example, preparation for image formation is not completed yet even when the operator completes operation, leading to such a waiting time that the operator needs to wait for the start of image formation.

FIG. 23 illustrates operation in a case (the present reference example) where the temperature of the fixing film 46*a* in the power-saving mode is 5° C. (the low-temperature state) and the specified value Vth is changed according to the temperature. The temperature of the fixing film 46*a* in the power-saving mode is lower than 10° C., and therefore, the specified value Vth is set to "2 V" as described above. Before a time point T of 0 second, the operator is not detected by the human detection sensor 61. When the operator approaches the image forming apparatus 100, the detection voltage V output from the human detection sensor 61 reaches 0.5 V (the time point T=0 second). Thereafter, when the detection voltage V output from the human detection sensor 61 reaches a specified value Vth of 2 V (the time point T=3 seconds), the determination portion 62 determines whether or not switching from the power-saving mode to the normal mode is to be performed. In this example, a case where the operator approaches the image forming apparatus 100 is assumed, and therefore, a detection voltage of equal to or higher than 2 V is continuously output. Then, at a time point T of 3.5 seconds, i.e., a time point at which the count value C reaches a specified count value Cx of 5, switching from the power-saving mode to the normal mode is performed, and the image forming apparatus 100 starts returning to the image formable state. Energization to the fixing device 46 begins at a time point T of 3.5 seconds, but the temperature of the fixing film 46*a* increases to such a temperature that the fixing device 46 is usable within about five seconds as described above in a case where the temperature of the fixing film 46*a* in the power-saving mode is equal to or higher than 5° C. Thus, preparation for image formation by the image forming apparatus 100 is completed at a time point T of 8.5 seconds. Meanwhile, the operator reaches such a position ((f) of FIG. 20) that the image forming apparatus 100 is operable until a time point T of 7 seconds, and operates the operation portion 5 for about two seconds to instruct the image forming apparatus 100 to start image formation (the time point T=9 seconds). As described above, preparation for image formation is completed until the operator completes operation in the present reference example, and therefore, image formation can be performed without keeping the operator waiting.

As described above, advantageous effects similar to those of the first reference example can be provided according to the present reference example.

Second Embodiment

Next, another embodiment of the present invention will be described. Basic configuration and operation of an image forming apparatus of the present embodiment are the same as those of the image forming apparatus of the first reference example. Thus, in the image forming apparatus of the present embodiment, the same numerals as those of the first reference example are used to represent elements having identical or corresponding functions or configurations to those of the image forming apparatus of the first reference example, and detailed description thereof will not be repeated.

1. Outline of Present Embodiment

In the present embodiment, a case where a time until driving of a polygon motor 43*c* of an exposure device 43 is stabilized in low-temperature environment is long as in the first embodiment and a reflection sensor is used as a human detection sensor 61 as in the second reference example will be described.

Note that in the present embodiment, a temperature sensor 7 is, as in the first embodiment, arranged in the vicinity of the exposure device 43 of a printer portion 4 (the temperature sensor 7 may be arranged in the exposure device 43), thereby detecting the temperature of ambient atmosphere of the exposure device 43.

2. Problems in Low-Temperature State (Driving of Polygon Motor)

In the present embodiment, the time until driving of the polygon motor 43*c* of the exposure device 43 is stabilized in the low-temperature environment might be long as in the first embodiment.

For this reason, in the present embodiment, in a case where the temperature of ambient atmosphere of the exposure device 43 detected by the temperature sensor 7 is lower than a predetermined value, response sensitivity in power supply according to a detection result of the human detection sensor 61 is increased as in the first embodiment. More specifically, in the present embodiment, a main controller portion 2 more decreases a specified value Vth in a case where the temperature of ambient atmosphere of the exposure device 43 is lower than 10° C. than in a case where such a temperature is equal to or higher than 10° C. In the present embodiment, the specified value Vth is, as in the second reference example, set to "3 V" in a case where the temperature detected by the temperature sensor 7 is equal to or higher than 10° C., and is set to "2 V" in a case where such a temperature is lower than 10° C.

3. Control Procedure

The procedure of sensitivity changing processing performed by the main controller portion 2 in the present embodiment is similar to that described with reference to FIG. 18 in the second reference example. Note that in the present embodiment, the main controller portion 2 acquires the temperature X of ambient atmosphere of the exposure device 43 detected by the temperature sensor 7 in the processing corresponding to the processing of S301 of FIG. 18.

Moreover, the procedure of power supply determination processing performed by a determination portion 62 in the present embodiment is the same as that described with reference to FIG. 19 in the second reference example.

4. Operation Example

A relationship between a time after power supply to the printer portion 4 including the exposure device 43 has begun and the rotation speed (the rotation period) of the polygon motor 43*c* in the present embodiment is the same as that described with reference to FIG. 12 in the first embodiment.

Moreover, a relationship between a situation where an operator approaches an image forming apparatus 100 and a detection voltage output from the human detection sensor 61 in such a situation in the present embodiment is the same as that described with reference to FIG. 20 in the second reference example.

Figure 24:
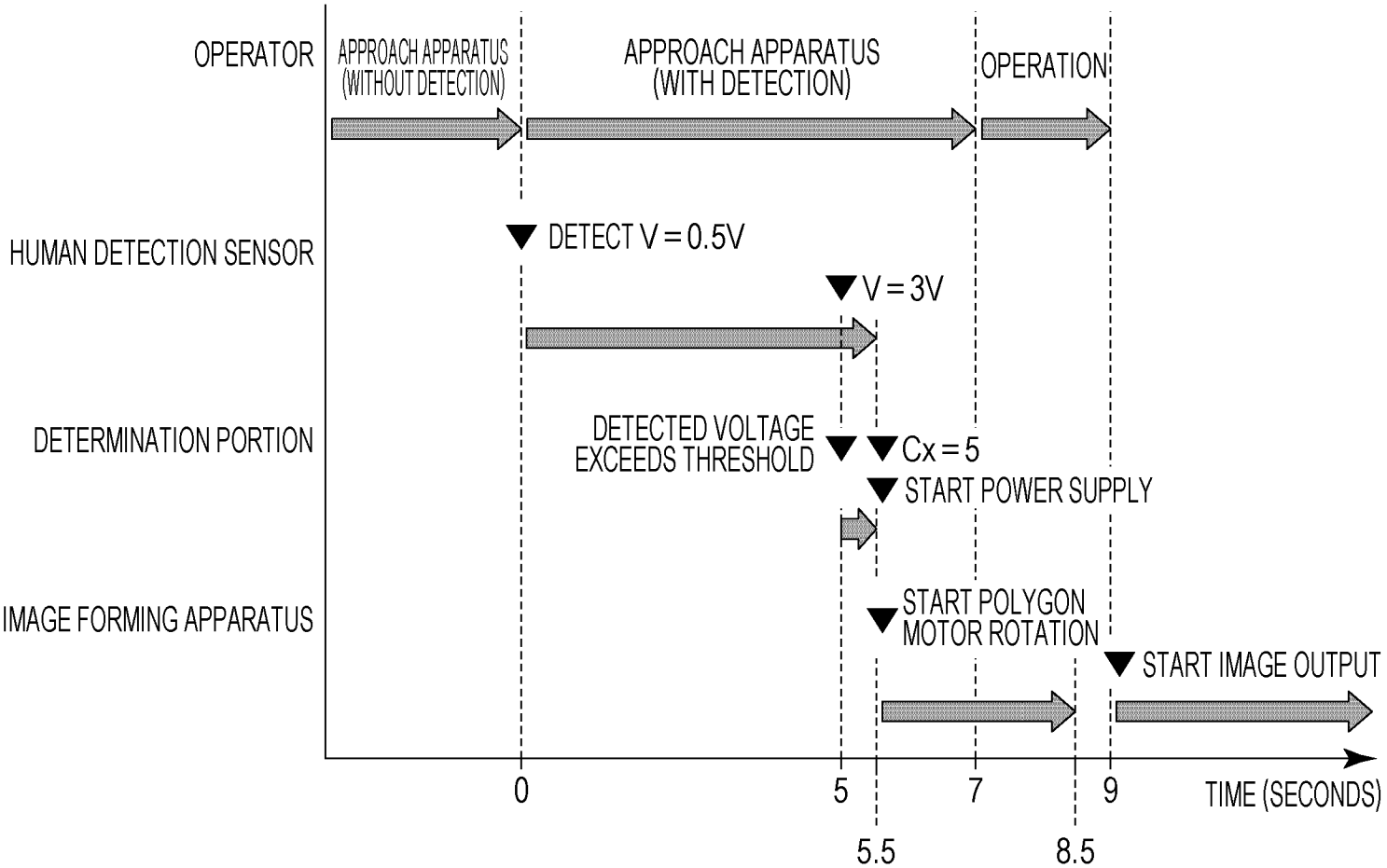
FIG. 24 is a schematic chart for describing operation in the high-temperature state in a second embodiment.
Figure 25:
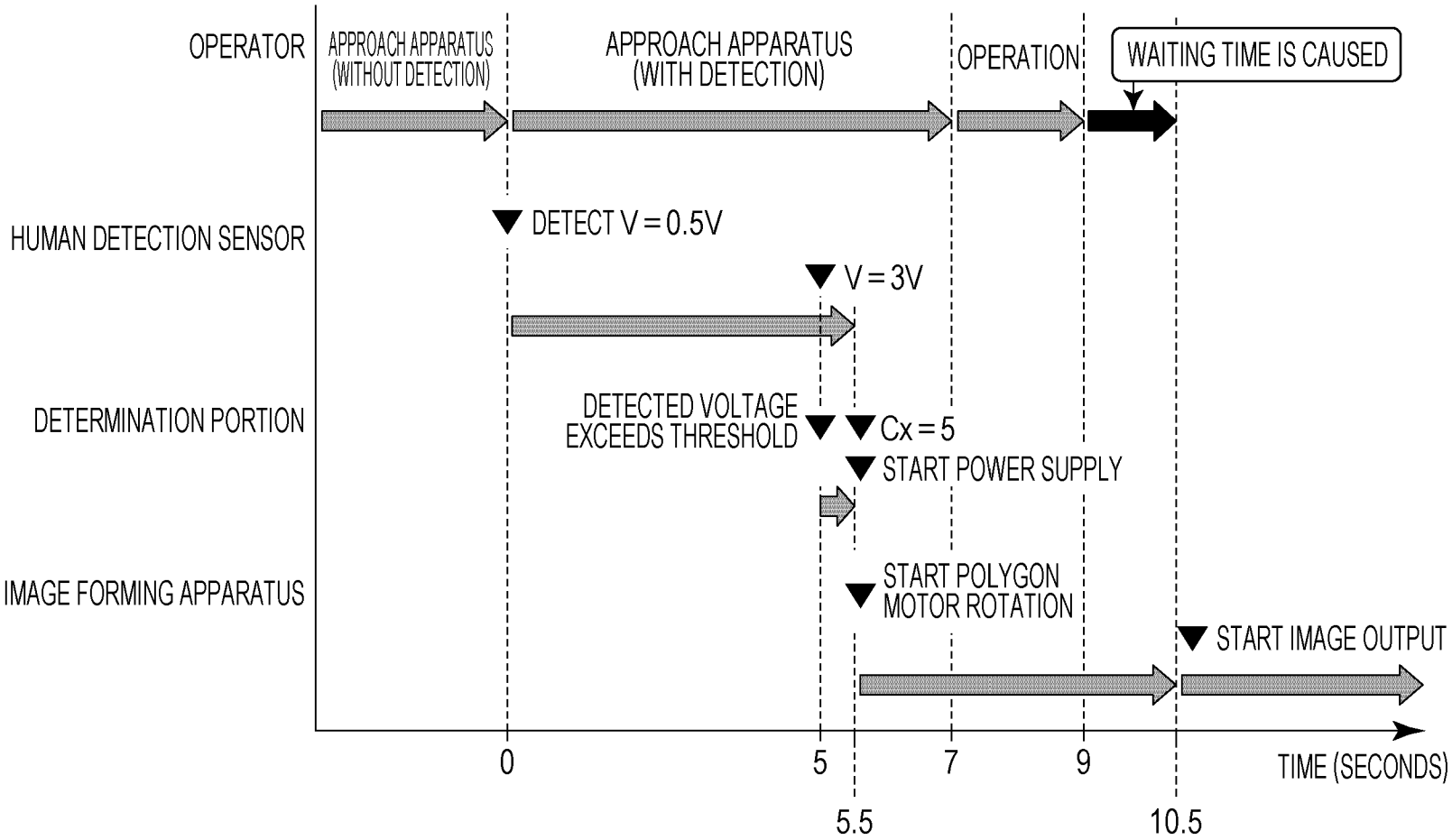
FIG. 25 is a schematic chart for describing operation in the low-temperature state in a comparative example.
Figure 26:
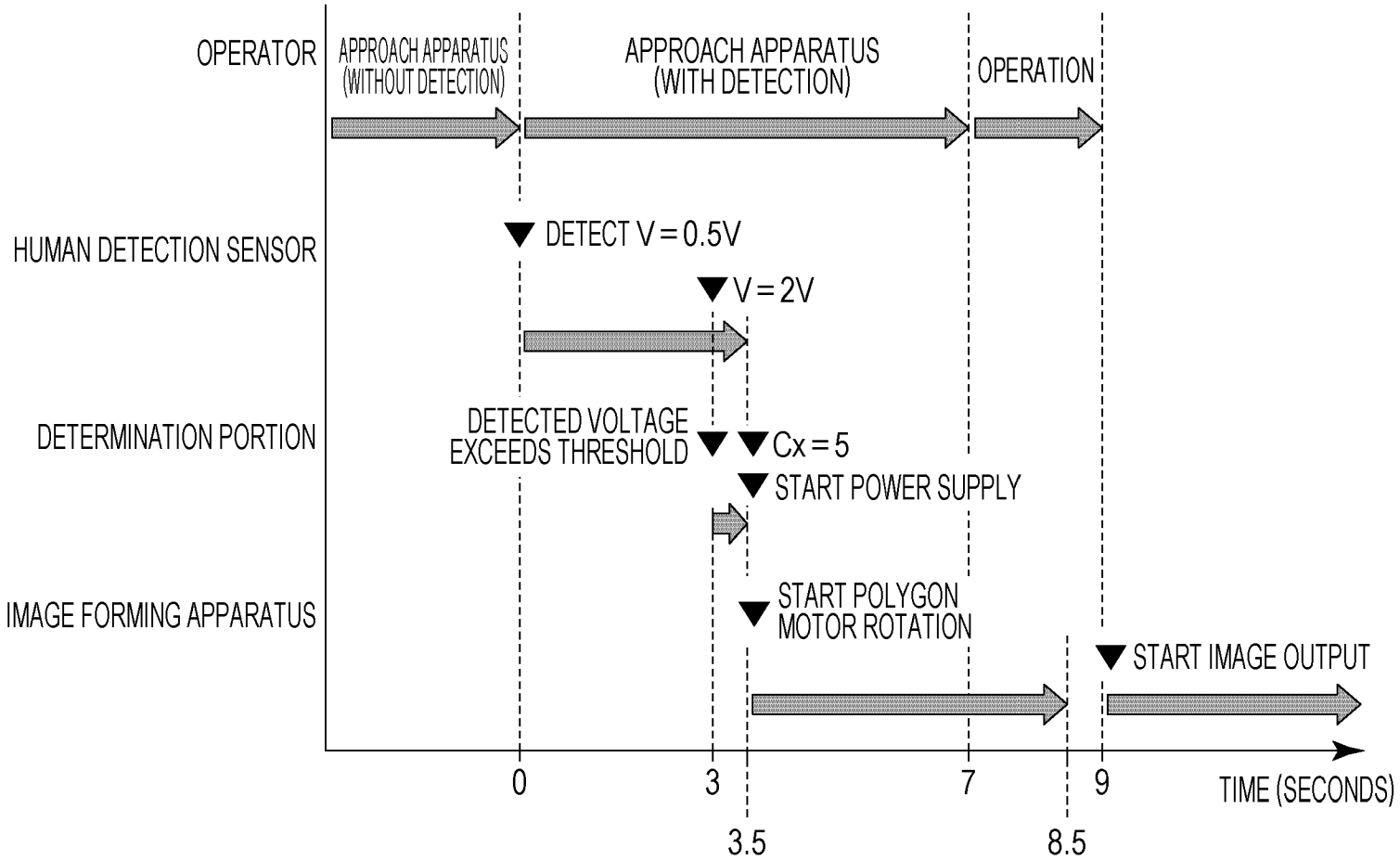
FIG. 26 is a schematic chart for describing operation in the low-temperature state in the second embodiment.

FIGS. 24 to 26 are schematic charts of a temporal relationship in operation among the portions upon power supply. FIG. 24 illustrates operation (corresponding to operation of the present embodiment in a case where the temperature of ambient atmosphere of the exposure device 43 is equal to or higher than 10° C.) in a case (a high-temperature state) where the temperature of ambient atmosphere of the exposure device 43 is 15° C. FIG. 25 illustrates operation in a case (a comparative example) where the temperature of ambient atmosphere of the exposure device 43 is 5° C. (a low-temperature state) and the specified value Vth is constantly set to "3 V" regardless of the temperature. FIG. 26 illustrates operation in a case (the present embodiment) where the temperature of ambient atmosphere of the exposure device 43 is 5° C. (the low-temperature state) and the specified value Vth is changed according to the temperature. In the present embodiment, times until driving of the polygon motor 43*c* is stabilized after power supply to the exposure device 43 has begun in a case where the temperature of ambient atmosphere of the exposure device 43 is 15° C. and 5° C. are each three seconds and five seconds. These values are the same as the times until the temperature of the fixing film 46*a* increases to such a temperature that the fixing device 46 is usable after the start of power supply to the fixing device 46 in a case where the temperature of the fixing film 46*a* in the second reference example is 15° C. and 5° C. Thus, the temporal relationship in operation among the portions as illustrated in FIGS. 24 to 26 is similar to that described with reference to FIGS. 21 to 23 in the second reference example. Note that the timing ("INCREASE FIXING TEMPERATURE" in the figures) of starting power supply to the fixing device 46 in FIGS. 21 to 23 is the timing ("START POLYGON MOTOR ROTATION" in the figures) of starting power supply to the exposure device 43 in FIGS. 24 to 26. In the present embodiment, preparation for image formation is, even in the low-temperature state, completed until the operator completes operation as illustrated in FIG. 26, and therefore, image formation can be performed without keeping the operator waiting.

As described above, advantageous effects similar to those of the first embodiment can be provided according to the present embodiment.

Other Embodiments

The present invention has been described above with reference to the specific embodiments, but is not limited to the above-described embodiments.

In each of the above-described embodiments, the temperature range is divided into two levels of low and high temperatures, and the response sensitivity in power supply according to the detection result of the human detection sensor is differentiated according to the temperature range. However, the present invention is not limited to such a configuration, and the temperature range may be divided into three or more levels. Moreover, the response sensitivity in power supply according to the detection result of the human detection sensor may be differentiated in a stepwise manner according to the temperature range. In this case, the sensitivity is relatively higher in the relatively-low temperature range than in the relatively-high temperature range. With this configuration, an increase in the sensitivity with respect to the temperature more than necessary is suppressed, and lowering of energy saving performance can be suppressed.

Moreover, in the first embodiment, the shape of the heat source (the human body) is detected as the temperature distribution by means of the infrared array sensor, but the shape of the object (the human body) may be detected by means of an image pickup element (a camera). The case of using the image pickup element is different from the case of using the infrared array sensor in the first embodiment in that the principle of determining, based on an acquired image, whether or not the person is present is used. However, in this case, control similar to that of the first embodiment can be performed by means of acquired information. That is, in the case of using the human detection sensor having the multiple detection portions configured such that the number of detection portions detecting the human body increases as the human body approaches the image forming apparatus, the human detection sensor may be an image pickup element including multiple photosensitive portions as the multiple detection portions.

Further, in the second embodiment, the sensor configured to detect reflection of the infrared light is used as the reflection sensor, but the reflection sensor may be configured to detect reflection of visible light. An ultrasonic sensor configured to detect reflection of ultrasonic waves may be used as the sensor configured to detect reflection from a reflection body (the human body). The ultrasonic sensor is different from the reflection sensor of the second embodiment in that the ultrasonic sensor does not detect the intensity of the reflected light, but uses the principle of calculating a distance from a relationship between a time required for reception of the ultrasonic waves after transmission and a sound speed. However, in this case, control similar to that of the second embodiment can be also performed by means of the obtained distance information. That is, in the case of using the human detection sensor configured to output the signal changeable in the predetermined direction as one of the value increasing direction or the value decreasing direction when the human body approaches the image forming apparatus, such a human detection sensor may be the ultrasonic sensor configured to detect reflection of the ultrasonic waves from the human body.

In addition, in the first and second embodiments, the temperature sensor is configured to detect the temperature of ambient atmosphere of the exposure device, but a temperature sensor configured to detect the inner temperature of the image forming apparatus or a temperature sensor configured to detect the outer temperature of the image forming apparatus may be used. In the case of using the human detection sensor including the thermosensitive portions, such as the infrared array sensor, the temperature detection value (the background temperature) in a case where no person is present in the detection area may be used as the temperature detection value for determination on whether or not the sensitivity is to be changed. That is, the temperature detection unit is not limited to the unit configured to detect the temperature of a target exposure device unit itself as long as the sensitivity can be changed according to the temperature with a sufficient accuracy, and may be configured to detect at least one of the inner or outer temperature of the main body of the image forming apparatus.

Moreover, in the above-described embodiments, the sensitivity changing portion configured to change the sensitivity in power supply according to the detection result of the human detection sensor changes the threshold compared with the detection result of the human detection sensor, thereby changing the sensitivity. However, the present invention is not limited to such an aspect. In predetermined low-temperature environment, the operator approaching the image forming apparatus may be, at the position farther from the image forming apparatus as compared to that in higher-temperature environment, detected so that power can be supplied. Thus, it may be configured such that a farther movable body can be detected by an increase in the output of the sensor according to the configuration of the human detection sensor, or the detection region of the sensor can be expanded by a mechanism configured to narrow a screening region of a screening body configured to screen some of the detection portions. These sensitivity changing units include those described in the above-described embodiments, and can be used in combination as necessary.

Further, in the above-described embodiments, the case where the exposure device is at least one of the power supply targets of the power source portion as the unit targeted for power supply has been described. Note that as long as the time until the target unit becomes usable after power supply is longer in the case of the second temperature lower than the first temperature than in the case of the first temperature, the present invention is applied to provide advantageous effects similar to those of the above-described embodiments.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-072715, filed Mar. 31, 2017, which is hereby incorporated by reference herein in its entirety.

What is claimed is:

1. An image forming apparatus comprising:

a rotatable photosensitive body;

an optical unit including a rotor configured to scan the photosensitive body with laser light from a laser light source and a rotor motor configured to drive the rotor, the optical unit configured to form an electrostatic latent image on the photosensitive body;

an image forming portion configured to form an image on a recording material based on the electrostatic latent image formed on the photosensitive body;

a human body detection sensor configured to detect a human body in a predetermined region near the image forming apparatus;

a recognition portion configured to recognize a presence of the human body in a case where a detection value from the human body detection sensor exceeds a threshold value;

a temperature sensor provided in the optical unit and configured to detect a temperature in a vicinity of the rotor;

an adjustment portion configured to adjust the threshold value;

wherein the adjustment portion adjusts the threshold value to be a first threshold value in a case where the temperature detected by the temperature sensor is a first temperature and adjusts the threshold value to be a second threshold value that is larger than the first threshold value in a case where the temperature detected by the temperature sensor is a second temperature that is higher than the first temperature, a control unit configured to start rotation of the rotor in a case where the recognition portion recognizes the presence of the human body, wherein the first threshold value and the second threshold value are determined based at least in part on a time required, after driving of the rotor motor is started, for a rotation speed of the rotor motor to reach a rotation speed necessary for image formation, the required time varying depending on an ambient temperature in the vicinity of the rotor.

2. The image forming apparatus according to claim 1, wherein the human body detection sensor includes an infrared sensor including a thermosensitive portion.

3. The image forming apparatus according to claim 2, wherein the infrared sensor includes multiple thermosensitive portions.

4. The image forming apparatus according to claim 3, wherein the sensitivity of the human body detection sensor is the number of thermosensitive portions having detected the human body, and the human body detection sensor is configured such that the number of thermosensitive portions having detected the human body and corresponding to the second threshold value is greater than the number of thermosensitive portions having detected the human body and corresponding to the first threshold value.

5. The image forming apparatus according to claim 1, wherein the human body detection sensor is an image pickup element including a photosensitive portion.

6. The image forming apparatus according to claim 5, wherein the human body detection sensor includes an image pickup element including multiple photosensitive portions.

7. The image forming apparatus according to claim 6, wherein the sensitivity of the human body detection sensor is the number of photosensitive portions having detected the human body, and the human body detection sensor is configured such that the number of photosensitive portions corresponding to the second threshold value is greater than the number of photosensitive portions corresponding to the first threshold value.

8. The image forming apparatus according to claim 1, wherein the human body detection sensor includes a sensor configured to detect infrared light, visible light, or an ultrasonic wave reflected from the human body.

9. The image forming apparatus according to claim 1, further comprising:

an operation portion configured to allow an operator to perform operation for the image formation, wherein the predetermined region is provided on an arrangement side of the operation portion in the image forming apparatus.

10. An image forming apparatus comprising:

an image forming portion configured to form an image on a recording material;

an image heating device including a heating member that generates heat by energization and configured to heat the image on the recording material formed by the image forming portion;

a temperature sensor configured to detect a temperature of the image heating device;

a human body detection sensor configured to detect a human body in a predetermined region near the image forming apparatus;

a recognition portion configured to recognize a presence of the human body in a case where a detection value from the human body detection sensor exceeds a threshold value;

an adjustment portion configured to adjust the threshold value;

wherein the adjustment portion adjusts the threshold value to be a first threshold value in a case where the temperature detected by the temperature sensor is a first temperature and adjusts the threshold value to be a second threshold value that is larger than the first threshold value in a case where the temperature detected by the temperature sensor is a second temperature that is higher than the first temperature; and a control unit configured to start energization to the heating member in a case where the recognition portion recognizes the presence of the human body, wherein the detection value from the human body detection sensor, used by the recognition portion in recognizing the presence of the human body, represents a number of thermosensitive portions that have detected the human body, and wherein the number of thermosensitive portions corresponding to the first threshold value is smaller than the number of thermosensitive portions corresponding to the second threshold value.

* * * * *